US008598804B2

(12) United States Patent
Foxall et al.

(10) Patent No.: US 8,598,804 B2
(45) **Date of Patent: *Dec. 3, 2013**

(54) APPARATUS AND METHOD FOR LED LIGHT CONTROL

(75) Inventors: Thomas George Foxall, Surrey (CA); Miroslaw Marek Grotkowski, North Vancouver (CA); Stephen Christian Wilson, Vancouver (CA); Tom William Thornton, North Vancouver (CA); Brent York, Langley (CA)

(73) Assignee: Light-Based Technologies Incorporated, Vancouver (CA)

( * ) Notice: Subject to any disclaimer, the term of this patent is extended or adjusted under 35 U.S.C. 154(b) by 270 days.

This patent is subject to a terminal disclaimer.

(21) Appl. No.: 13/093,705

(22) Filed: Apr. 25, 2011

(65) Prior Publication Data

US 2012/0062138 A1 Mar. 15, 2012

Related U.S. Application Data

(63) Continuation-in-part of application No. 12/785,383, filed on May 21, 2010, now Pat. No. 8,441,202.

(60) Provisional application No. 61/279,755, filed on Oct. 26, 2009.

(51) Int. Cl.
*H05B 37/02* (2006.01)

(52) U.S. Cl.
USPC ..... 315/291; 315/294; 315/307

(58) Field of Classification Search
USPC ..... 315/291, 292, 294–295, 297, 307, 308, 315/312, 318
See application file for complete search history.

(56) References Cited

U.S. PATENT DOCUMENTS

| | | | | |
|---|---|---|---|---|
| 2,935,607 | A | 5/1960 | Koch | |
| 4,420,711 | A | 12/1983 | Takahashi et al. | |
| 5,160,831 | A | 11/1992 | Thaler | |
| 5,430,356 | A | 7/1995 | Ference et al. | |
| 6,016,038 | A | 1/2000 | Mueller et al. | |
| 6,204,650 | B1 | 3/2001 | Shimamori | |
| 6,205,197 | B1 | 3/2001 | Ananth | |
| 6,259,351 | B1 | 7/2001 | Radosavljevic et al. | |
| 6,486,616 | B1 * | 11/2002 | Liu et al. | 315/291 |
| 6,713,974 | B2 * | 3/2004 | Patchornik et al. | 315/295 |

(Continued)

FOREIGN PATENT DOCUMENTS

| | | |
|---|---|---|
| CA | 2662642 | 2/2006 |
| GB | 846387 A | 8/1960 |

(Continued)

OTHER PUBLICATIONS http://www.lumitech.bnet.at/light-management-systems_13.htm, printed Apr. 19, 2010.

(Continued)

*Primary Examiner* — Tung X Le
(74) *Attorney, Agent, or Firm* — Oyen Wiggs Green & Mutala LLP

(57) ABSTRACT

An illumination apparatus comprises a plurality of LEDs and a control system connected to receive dimmer-modulated AC line voltage and control the LEDs. The control system is configured to operate in a plurality of different modes wherein changes in dimmer-modulated AC line voltage adjust various characteristic of the LEDs.

36 Claims, 18 Drawing Sheets

(56) References Cited

U.S. PATENT DOCUMENTS

| | | | | |
|---|---|---|---|---|
| 6,927,541 | B2 | 8/2005 | Lee | |
| 6,967,448 | B2 | 11/2005 | Morgan et al. | |
| 7,031,920 | B2 | 4/2006 | Dowling et al. | |
| 7,038,399 | B2 | 5/2006 | Lys et al. | |
| 7,064,498 | B2 | 6/2006 | Dowling et al. | |
| 7,102,902 | B1 * | 9/2006 | Brown et al. | 363/89 |
| 7,186,003 | B2 | 3/2007 | Dowling et al. | |
| 7,190,125 | B2 | 3/2007 | McDonough et al. | |
| 7,352,138 | B2 * | 4/2008 | Lys et al. | 315/291 |
| 7,358,679 | B2 | 4/2008 | Lys et al. | |
| 7,518,885 | B2 | 4/2009 | Baurle et al. | |
| 7,520,634 | B2 | 4/2009 | Ducharme et al. | |
| 7,564,196 | B2 | 7/2009 | Shiwaya et al. | |
| 7,592,925 | B2 | 9/2009 | Nearhoof et al. | |
| 7,639,048 | B2 | 12/2009 | Lin | |
| 7,644,220 | B2 | 1/2010 | Moriyama et al. | |
| 7,646,029 | B2 | 1/2010 | Mueller et al. | |
| 7,663,325 | B2 | 2/2010 | McDonough et al. | |
| 7,667,408 | B2 | 2/2010 | Melanson et al. | |
| 7,759,881 | B1 | 7/2010 | Melanson | |
| 7,812,544 | B2 | 10/2010 | Morales et al. | |
| 8,107,825 | B2 | 1/2012 | Rajagopal et al. | |
| 2004/0047153 | A1 | 3/2004 | Lee | |
| 2004/0085030 | A1 * | 5/2004 | Laflamme et al. | 315/291 |
| 2004/0212321 | A1 | 10/2004 | Lys et al. | |
| 2005/0285547 | A1 | 12/2005 | Piepgras et al. | |
| 2007/0182347 | A1 | 8/2007 | Shteynberg et al. | |
| 2009/0134814 | A1 | 5/2009 | Moon et al. | |
| 2009/0160369 | A1 | 6/2009 | Godbole et al. | |
| 2009/0278479 | A1 | 11/2009 | Platner et al. | |
| 2010/0134042 | A1 | 6/2010 | Willaert | |
| 2011/0080110 | A1 | 4/2011 | Nuhfer | |
| 2011/0080111 | A1 | 4/2011 | Nuhfer et al. | |

FOREIGN PATENT DOCUMENTS

| | | | |
|---|---|---|---|
| WO | 9201968 | A1 | 2/1992 |
| WO | 2009102192 | A1 | 8/2009 |
| WO | 2009102195 | A2 | 8/2009 |
| WO | 2010021675 | A1 | 2/2010 |

OTHER PUBLICATIONS http://www.homeauto.com/Products/HLC/600WSwitch.asp, printed Jul. 14, 2010.

Lind, Eric, Lutron comments on Integral LED Lamp, Feb. 27, 2009.

www.douglaslightingcontrols.com, ALD Dimmer Specification, Nov. 2007.

Dimmer Manual, Jan. 7, 2008.

www.jellephishmoodlamps.com/contents/en-us/d84.htmp, printed Jul. 14, 2011.

* cited by examiner

APPARATUS AND METHOD FOR LED LIGHT CONTROL

REFERENCE TO RELATED APPLICATION

This application is a continuation-in-part of U.S. patent application Ser. No. 12/785,383 filed 21 May 2010, which claims the benefit under 35 U.S.C. §119 of U.S. Patent Application No. 61/279,755 filed on 26 Oct. 2009. Both of these applications are hereby incorporated herein by reference.

TECHNICAL FIELD

The invention relates to control of LED-based illumination apparatus.

BACKGROUND

Light-emitting diodes (LEDs) may be used in illumination apparatus for lighting rooms or other indoor or outdoor areas. Some LED-based illumination apparatus comprise a plurality of LEDs of different colors. Light from each of the plurality of different colored LEDs may combine to yield a composite color. By modulating the intensity of light from each different colored LED, such illumination apparatus may provide light having a range of intensities and colors.

Many existing lighting installations provide AC dimmer switches originally installed to control the brightness of incandescent light sources. The modulated AC line voltage produced by operation of such dimmer switches must typically be processed in order to control a LED-based illumination apparatus.

The inventors have determined a need for improved apparatus and methods for controlling the intensity and color of light emitted from LED-based illumination apparatus.

SUMMARY

One aspect provides an illumination apparatus comprising a plurality of LEDs and a control system connected to receive dimmer-modulated AC line voltage and control the plurality of LEDs. The control system is configured to operate in a default mode wherein changes in dimmer-modulated AC line voltage adjust a first characteristic of the plurality of LEDs until the dimmer-modulated AC line voltage manifests a mode change condition, enter a selected mode wherein changes in dimmer-modulated AC line voltage adjust a second characteristic of the plurality of LEDs upon determining that the dimmer-modulated AC line voltage manifests the mode change condition, and, enter a different mode after the dimmer-modulated AC line voltage remains unchanged for a first predetermined time period.

Another aspect provides a method for controlling an LED-based illumination apparatus comprising a plurality of LEDs. The method comprises receiving dimmer-modulated AC line voltage, controlling the LEDs in a default mode whereby changes in the dimmer-modulated AC line voltage are transformed into changes in a first characteristic of the plurality of LEDs until the dimmer-modulated AC line voltage manifests a mode change condition, controlling the LEDs in a selected mode whereby changes in dimmer-modulated AC line voltage are transformed into changes in a second characteristic of the plurality of LEDs upon determining that the dimmer-modulated AC line voltage manifests the mode change condition, and, controlling the LEDs in a different mode after the dimmer-modulated AC line voltage remains unchanged for a first predetermined time period.

Another aspect provides an illumination apparatus comprising a plurality of LEDs, and a control system connected to receive dimmer-modulated AC line voltage and control the plurality of LEDs. The control system is configured to operate in a default mode wherein changes in dimmer-modulated AC line voltage adjust a first characteristic of the plurality of LEDs until the dimmer-modulated AC line voltage manifests a first mode change condition, enter a scanning mode upon determining that the dimmer-modulated AC line voltage manifests the first mode change condition wherein the control system automatically adjusts a second characteristic of the plurality of LEDs to scan through a range of adjustment settings, and, set the second characteristic of the plurality of LEDs based on a current setting in the range of adjustment settings and enter a different mode upon determining that the dimmer-modulated AC line voltage manifests a second mode change condition.

Another aspect provides a method for controlling an LED-based illumination apparatus comprising a plurality of LEDs. The method comprises receiving dimmer-modulated AC line voltage, controlling the LEDs in a default mode whereby changes in the dimmer-modulated AC line voltage are transformed into changes in a first characteristic of the plurality of LEDs until the dimmer-modulated AC line voltage manifests a first mode change condition, controlling the LEDs in a scanning mode upon determining that the dimmer-modulated AC line voltage manifests the first mode change condition wherein in the scanning mode a second characteristic of the plurality of LEDs is automatically adjusted to scan through an available range of adjustment settings, and, setting the second characteristic based on a current setting in the range of adjustment setting and controlling the LEDs in a different mode when the dimmer-modulated AC line voltage manifests a second mode change condition.

Further aspects and details of example embodiments are described below.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
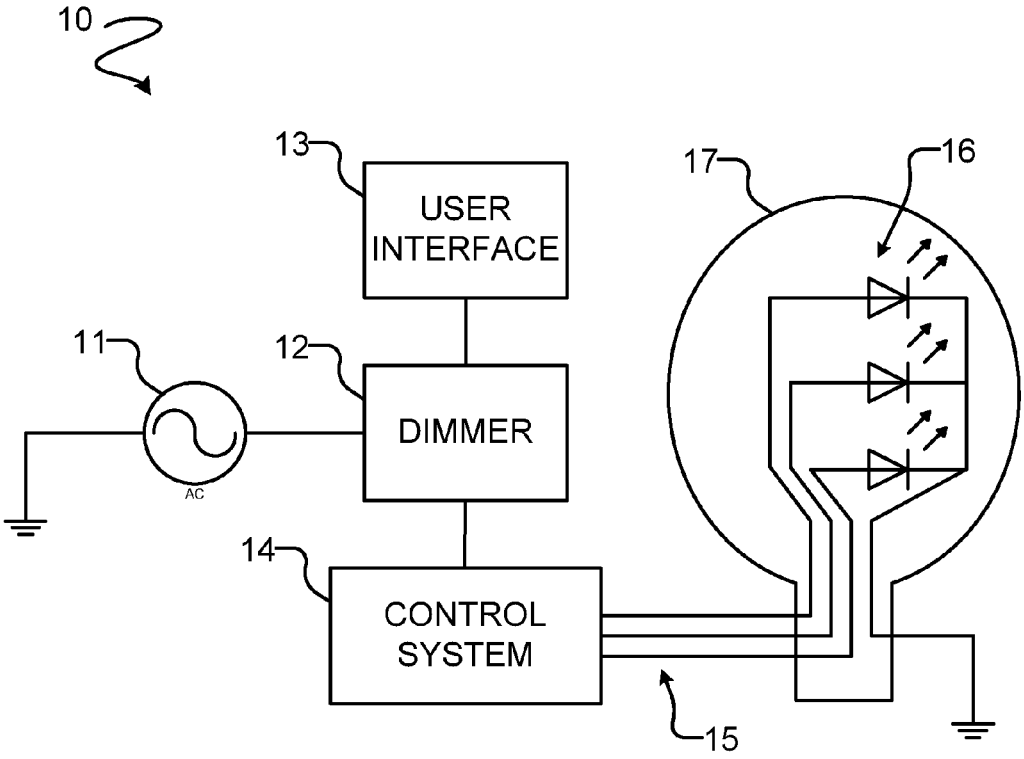
FIG. 1 is a schematic view of a LED-based illumination apparatus according to an example embodiment.

FIG. 1 shows a LED-based illumination apparatus 10 according to an example embodiment. An AC line voltage 11 is provided to an AC-dimmer 12. The AC-dimmer 12 modulates the AC line voltage 11 according to input from a user interface 13. User interface 13 may comprise, for example, a knob, a dial, a slider, a lever, a touchpad, an array of switches, an audio-controlled interface, a light-controlled interface, a computer-controlled interface, or any other type of interface. The dimmer-modulated AC voltage is provided to a control system 14. Control system 14 provides output DC voltages 15 to a plurality of LEDs 16. In the illustrated embodiment, the plurality of LEDs 16 are packaged together in a lighting instrument 17. The term "lighting instrument" as used herein is to be understood to refer to any type of apparatus which emits light including, for example and without limitation, luminaires, lamps, light bulbs, etc.

The term "LED" as used herein is to be understood to include any electroluminescent diode or other type of carrier injection/junction-based component that generates electromagnetic radiation in response to an electrical signal, including, without limitation, semiconductor-based structures that emit light in response to current, light emitting polymers, electroluminescent structures, and the like. The term LED may refer to any type of light emitter (including semi-conductor and organic light emitting diodes) that generate radiation in the visible, infrared and/or ultraviolet spectrums. Also, the term LED does not necessarily imply a particular type of physical and/or electrical package. For example, the term LED may refer to a single light emitting device having multiple elements that may or may not be individually controllable that are configured to respectively emit different spectra of radiation. Also, a LED may include a phosphor that is considered as part of the LED (as in, for example, some white LEDs). The term LED may refer to, for example and without limitation, packaged LEDs including T-package mount LEDs, radial package LEDs, and power package LEDs, non-packaged LEDs, surface mount LEDs, chip-on-board LEDs, LEDs with casings and/or optical elements such as, for example, diffusing lenses, etc.

Figure 2:
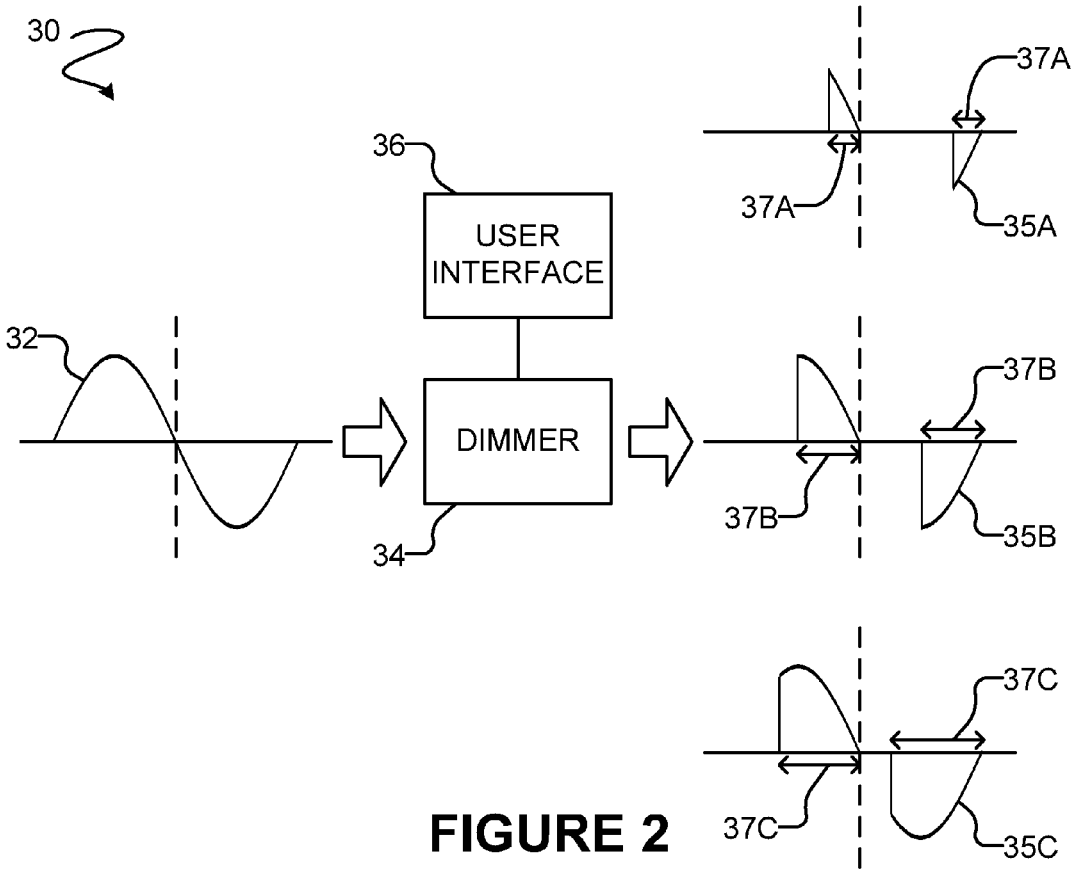
FIGURE 2 (PRIOR ART)
FIG. 2 is a schematic illustration of the operation of one type of prior art AC-dimmer.

FIG. 2 illustrates operation of one type of conventional AC-dimmer. FIG. 2 shows an example AC voltage waveform 32 (e.g., representing a standard line voltage). A generalized AC-dimmer 34 is configured to adjust the duty cycle of its output AC voltage (e.g., by "chopping-out" portions of the periodic AC voltage) according to input from a user interface 36. As is shown in FIG. 2, the duty cycles 37A, 37B and 37C of output dimmer-modulated AC voltage waveforms 35A, 35B and 35C are different from each other. Such duty cycle control may be referred to as "phase cut angle modulation". One popular dimmer implementation uses a triac that may be selectively operated to adjust the duty cycle of the dimmer-modulated AC voltage by chopping-off increasing portions of the AC voltage half-cycles (i.e., after zero-crossing).

Figure 3:
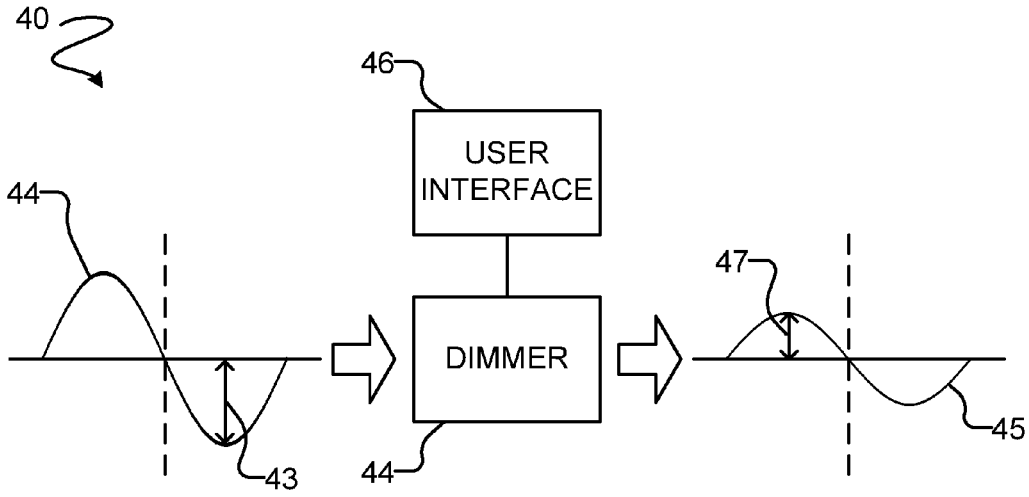
FIGURE 3 (PRIOR ART)
FIG. 3 is a schematic illustration of the operation of another type of prior art AC-dimmer.

FIG. 3 illustrates operation of another type of conventional AC-dimmer. FIG. 3 shows an example AC voltage waveform 42 (e.g., representing a standard line voltage). A generalized AC-dimmer 44 is configured to adjust the amplitude of its output AC voltage according to input from a user interface 46. As is shown in FIG. 3, the amplitude 47 of the output dimmer-modulated AC voltage waveform 45 is lower in comparison with the amplitude 43 of input AC voltage waveform 44.

Returning to FIG. 1, control system 14 is connected to receive AC line voltage as modulated by dimmer 12 and control LEDs 16 based on the AC line voltage. Control system 14 may control LEDs 16 individually or in groups. Control system 14 is configured to switch between two or more operating modes. In some embodiments, control system 14 is configured to selectively control one or more different characteristics of light emitted from LEDs 16 in each mode.

In some embodiments, control system 14 is configured to control the intensity of light output by an individual LED 16 or group of LEDs 16 by varying the level of current with which that LED or group is driven. In some embodiments, control system 14 is configured to control the intensity of light output by an LED or group by varying the duty cycle for that LED or group. In some embodiments, control system 14 is configured to control the intensity of light output by an LED or group by varying both the current level and duty cycle of the driving current.

In some embodiments, LEDs 16 comprise LEDs of different colors. The term "color" as used herein is to be understood to refer to one or more frequencies/wavelengths of electromagnetic radiation. For example, LEDs may emit radiation of a single frequency/wavelength, a narrow band of frequencies/wavelengths, or a wide band of frequencies/wavelengths. Thus, the expressions "LEDs of different colors" and the like refer to LEDs which emit radiation having different spectral characteristics, and includes, for example and without limitation, LEDs of notably different colors (e.g., red, green, blue, yellow, white, etc.) and LEDs of similar colors (e.g. warm white, cold white etc.).

The light from LEDs 16 mixes to yield a composite color, such that the overall intensity and color of light emitted by lighting instrument 17 is controlled by control system 14.

Control system 14 may, for example and without limitation, be configured to selectively control one or more of:

- the intensity of light from lighting instrument 17;
- the color of light from lighting instrument 17;
- a flashing and/or pulsing pattern of light from lighting instrument 17;
- a rate at which the flashing/pulsing pattern occurs and repeats; and/or
- other characteristics, in response to changes in AC line voltage conditions, depending on the currently active mode of control system 14.

In some embodiments, control system 14 is configured to control LEDs 16 so that lighting instrument 17 is operable to emit light over a range of intensities and colors according to user input provided via user interface 13. In some embodiments user interface 13 provides only one variable user input which controls AC-dimmer 12 to modulate a single property of the AC line voltage. For example, user interface 13 may comprise a knob turnable through a range of positions, and AC-dimmer 12 may modulate one of voltage duty cycle (e.g., phase cut angle), voltage amplitude, or the like according to the position of the knob. In such embodiments, control system 14 is responsive to particular dimmer-modulated AC voltage conditions in order to provide user control over both the intensity and color of light from lighting instrument 17.

In some embodiments, control system 14 has a default mode in which one characteristic of light from lighting instrument 17 is controlled. In the default mode, control system 14 monitors the AC line voltage for mode change conditions and switches to a selected mode only when a mode change condition occurs. In some such embodiments, control system 14 is configured to automatically change from the selected mode to a different mode or return from the selected mode to the default mode after a predetermined period of time, or after the AC line voltage conditions remain unchanged for a predetermined period of time.

For example, in some embodiments, control system 14 is configured to remain in an "intensity mode" wherein control system 14 is configured to transform changes in dimmer-modulated AC line voltage into changes in the overall intensity of light from lighting instrument 17 until a mode change condition is detected in the dimmer-modulated AC line voltage. When a mode change condition is detected, control system 14 may switch into a "color mode" wherein control system 14 is configured to transform changes in dimmer-modulated AC line voltage into changes in the composite color of light from lighting instrument 17. In some embodiments, the color is maintained constant while varying the intensity in the intensity mode. In some embodiments, the intensity is maintained constant while varying the color in the color mode. In some embodiments, both color and intensity may vary in either or both of the intensity and color modes.

Many LEDs require less power as compared with incandescent lamps to provide light of the same brightness. Accordingly, it is possible to cause the maximum overall light intensity to be emitted by lighting instrument 17 in situations where user interface 13 is not set to a maximum of its range. In some embodiments, control system 14 is operable to cause lighting instrument 17 to provide substantially uniformly bright light across a range of dimmer-modulated AC voltages (e.g., regardless of differences in maximum power deliverable across the range).

In some embodiments, control system 14 is separate from lighting instrument 17. In some embodiments control system 14 is partially or wholly combined into lighting instrument 17. For example, in some embodiments control system 14 and lighting instrument 17 are packaged together and configured to fit into a socket designed to receive an incandescent light bulb.

Figure 1A:
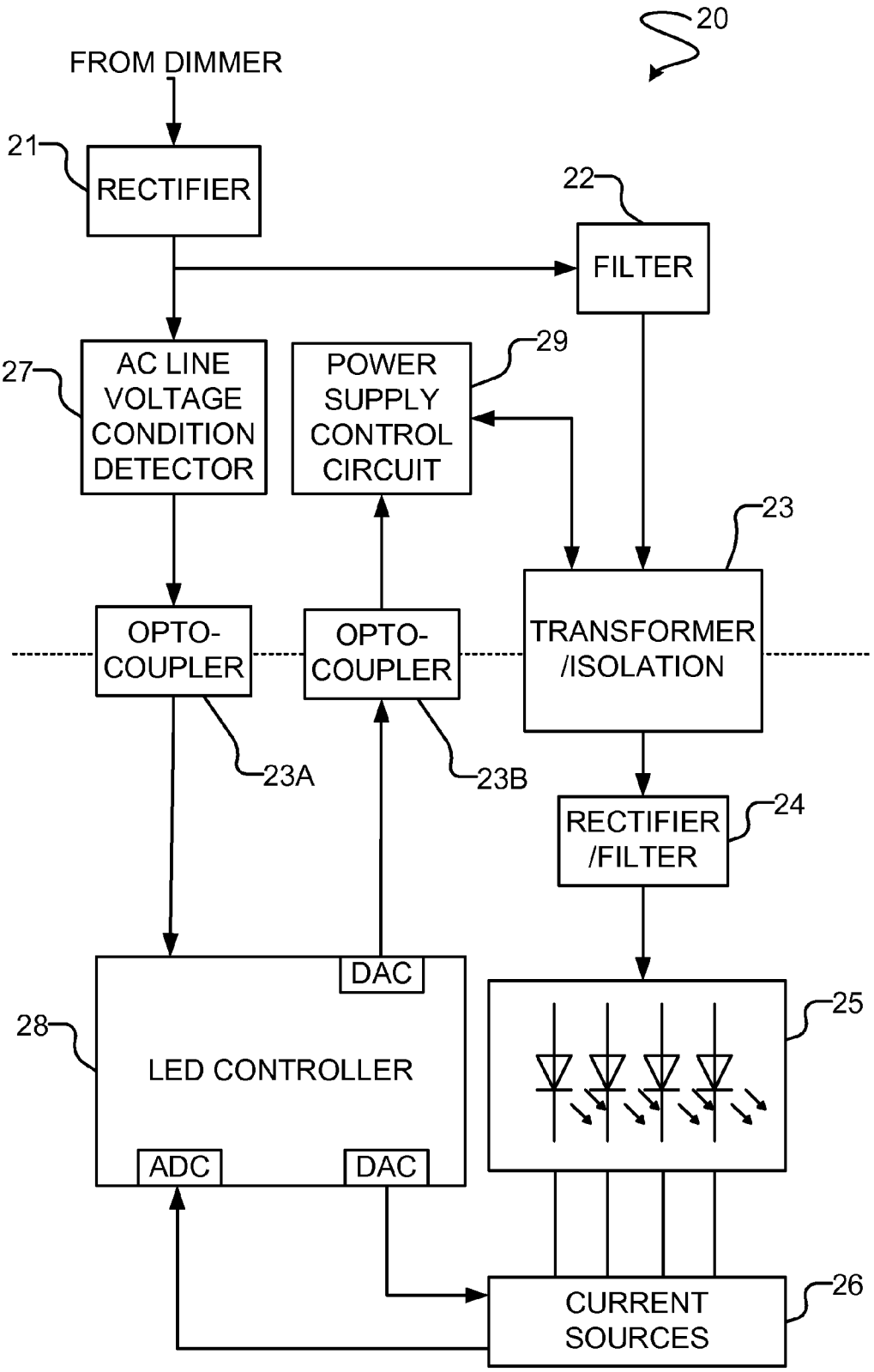
FIG. 1A is a block diagram of a LED-based illumination apparatus with a built in control system according to an example embodiment.

FIG. 1A shows a LED-based illumination apparatus 20 having a built in control system according to an example embodiment. Apparatus 20 comprises a rectifier 21 which receives modulated AC line voltage from a dimmer (not shown in FIG. 1A). The output of rectifier 21 is passed through a filtering circuit 22, a transformer 23, and then a further rectifiying/filtering circuit 24 to provide voltage for use by LEDs 25. Current sources 26 regulate the current passed through LEDs 25 in response to a control signal received from a LED controller 28. Controller 28 also measures the voltage drop across current sources 26.

An AC line voltage condition detector 27 also receives the output of rectifier 21 and provides a signal indicative of AC line voltage conditions to controller 28 through opto-coupler 23A. A power supply control circuit 29 receives an LED voltage control signal from controller 28 through opto-coupler 23B. Power supply control circuit 29 controls the operation of the primary circuit of transformer 23 to regulate the current provided to LEDs 25 based on the LED voltage control signal from controller 28. Transformer 23 and opto-couplers 23A and 23B provide voltage isolation to shield rectifier/filter 24, LEDs 25, current sources 26 and controller 28 from AC line voltage.

Controller 28 comprises a processor and memory storing instructions which configure the processor to carry out methods for controlling LEDs based on the dimmer modulated AC line voltage according to various embodiments. Controller 28 may also have memory allocated for storing values representative of dimmer modulated AC line voltage conditions for future use by the processor. Controller 28 is connected to receive various signals. Where the signals include analog signals then controller 28 may comprise an analog to digital converter. In the illustrated embodiment, controller 28 comprises an analog to digital converter (not specifically enumerated) for receiving analog signals from current sources 26. The analog to digital converter may optionally or in the alternative be connected to convert analog signals from other sources into a digital format. In the illustrated embodiment controller 28 comprises digital to analog converters (not specifically enumerated) for sending analog signals to current sources 26 and power supply control circuit 29.

Figure 4:
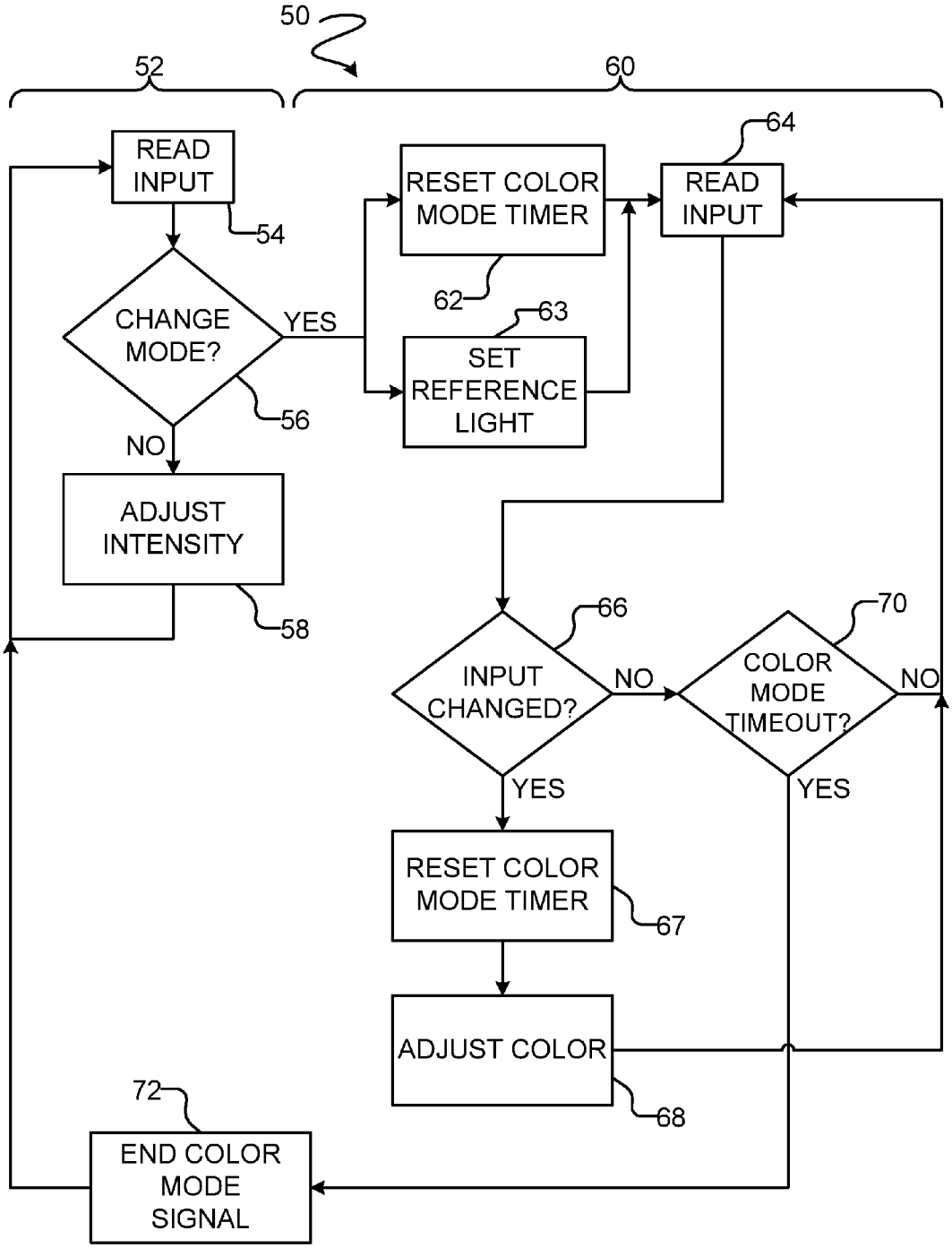
FIG. 4 is a flow chart of a method for controlling a LED-based illumination apparatus according to an example embodiment.

FIG. 4 shows a method 50 according to an example embodiment, which a control system for a LED-based illumination apparatus (such as, for example, control system 14) may be configured to execute. Method 50 comprises an intensity mode 52 and a color mode 60. In intensity mode 52, an input is read at step 54. The input may be, for example, a modulated AC voltage signal, another power-related signal from an AC source, a signal derived from either thereof, or the like. For example, the input could comprise an AC waveform which varies as shown in FIG. 2 or FIG. 3. In some embodiments, the input is read continuously or periodically throughout operation of method 50.

At step 56 the control system determines if the input manifests a mode change condition. A mode change condition may comprise, for example:

- a particular instantaneous signal value;
- a time averaged signal value;
- a interruption of signal for a predetermined time;
- a predetermined number of signal interruptions within a predetermined time;
- a particular rate of change of signal value;
- a particular time-dependent pattern of change in signal value;

a particular time-independent pattern of change in a signal value;

a combination thereof; and/or other conditions.

In some embodiments, a mode change may be indicated by a parameter of the AC line voltage (such as, for example, the phase cut angle or the amplitude) transitioning from below a threshold to above the threshold a predetermined number of times in a predetermined time period. For example, a mode change condition may occur when the AC line voltage parameter transitions from below to above to below to above to below 90% of its maximum value within 1.5 seconds in some embodiments. Other numbers of transitions, threshold levels, and/or time periods may indicate a mode change condition in other embodiments. In some embodiments, different thresholds may be used for detecting upward and downward transitions, wherein a slightly higher threshold is used for detecting upward transitions and a slightly lower threshold is used for detecting downward transitions. In some embodiments, the threshold level may be selected based on the current value of the parameter of the AC line voltage, such that a user may trigger a mode change by performing the same pattern of actions regardless of the current position of the user interface.

In some embodiments, a mode change may be indicated by the AC line voltage turning off and on a predetermined number of times within a predetermined time period. In such embodiments, a power cycle counter and power cycle timer may be stored in non-volatile memory, such that the values therein are preserved when the control system loses power.

In some embodiments, the mode change is indicated by the AC line voltage turning off and on a predetermined number of times in a row where the "on" time is less than a predetermined time period for each of the consecutive "on" times. In such embodiments, a power cycle counter may preserved in non-volatile memory, and timing information may or may not be preserved.

Figure 4A:
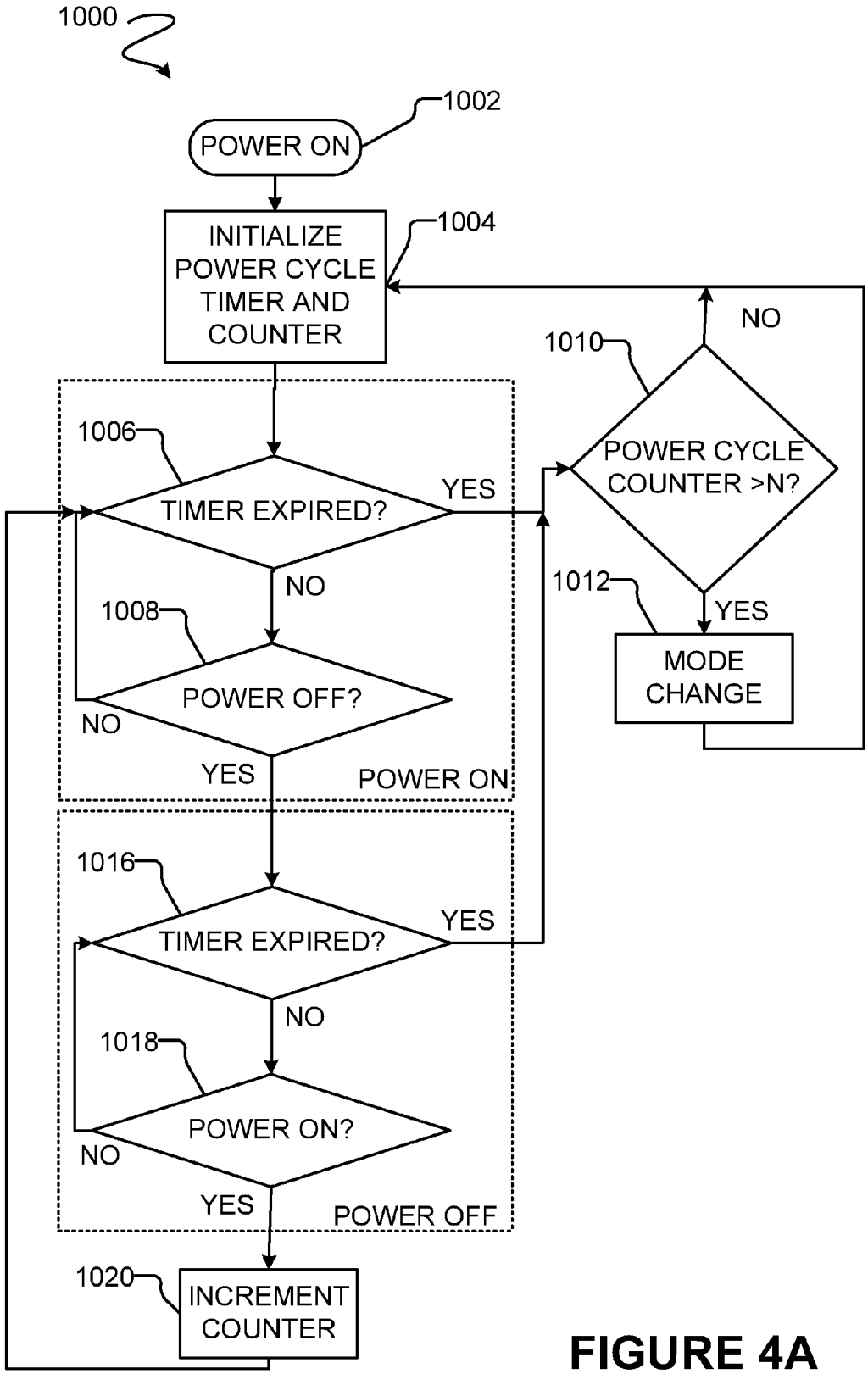
FIGS. 4A and 4B are flow charts showing example methods for changing control modes of a LED-based illumination apparatus according to another embodiment.

FIG. 4A shows an example method 1000 wherein power to the illumination apparatus is turned on at step 1002 and a power cycle timer and a power cycle counter are initialized (e.g., the timer is set to a predetermined time to count down, and the power cycle counter is set to 1) at step 1004. After step 1004, method 1000 proceeds to step 1006, where the timer is checked to determine if a predetermined amount of time has elapsed and the timer has expired. If not (step 1006 NO output), method 1000 proceeds to step 1008, where the control system checks whether power to the illumination apparatus has been turned off. If not (step 1008 NO output), method 1000 returns to step 1006. If the power has been turned off (step 1008 YES output), method 1000 proceeds to step 1016, where the timer is checked to determine if a predetermined amount of time has elapsed and the timer has expired. If not (step 1016 NO output), method 1000 proceeds to step 1018, where the control system checks whether power to the illumination apparatus has been turned on. If not (step 1018 NO output), method 1000 returns to step 1016. If the power has been turned off (step 1008 YES output), method 1000 proceeds to step 1020, where the power cycle counter is incremented. Method 1000 returns to step 1006 after step 1020. Steps 1006 and 1008 are surrounded by a dashed box labeled "POWER ON", and steps 1016 and 1018 are surrounded by a dashed box labeled "POWER OFF", to indicate when power is on/off to the illumination apparatus, but it is to be understood that power may still be available to the control system in some embodiments even when the illumination apparatus power is off.

If the timer expires (step 1006/1016 YES output), method 1000 proceeds to step 1010, where the counter is checked to determine if the power cycle counted exceeds a predetermined number N. In some cases, N may be 2. If not (step 1010 NO output), method 1000 returns to step 1004. If so (step 1010 YES output), method 1000 proceeds to step 1012, where the control system registers a mode change condition, then returns to step 1004.

Figure 4B:
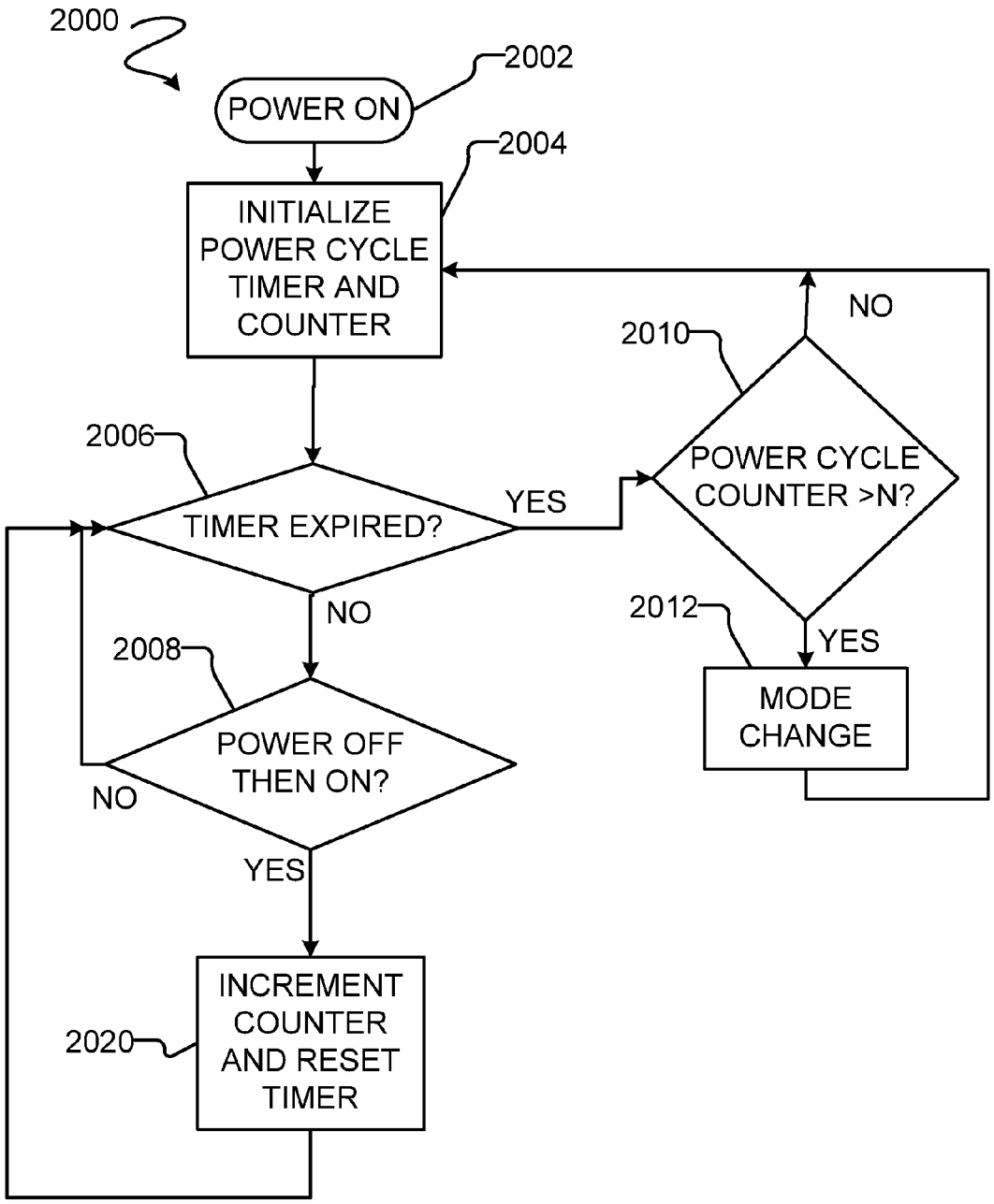

FIG. 4B shows an example method 2000 wherein power to the illumination apparatus is turned on at step 2002 and a power cycle timer and a power cycle counter are initialized (e.g., the timer is set to a predetermined time to count down, and the power cycle counter is set to 1) at step 2004. After step 2004, method 2000 proceeds to step 2006, where the timer is checked to determine if a predetermined amount of time has elapsed and the timer has expired. If not (step 2006 NO output), method 2000 proceeds to step 2008, where the control system checks whether power to the illumination apparatus has been turned off and then back on. If not (step 2008 NO output), method 2000 returns to step 2006. If the power has been turned off and back on (step 2008 YES output), method 2000 proceeds to step 2020, where the power cycle counter is incremented and the timer is reset. Method 2000 returns to step 2006 after step 2020. If the timer expires (step 2006 YES output), method 2000 proceeds to step 2010, where the counter is checked to determine if the power cycle counted exceeds a predetermined number N. In some cases, N may be 2. If not (step 2010 NO output), method 2000 returns to step 2004. If so (step 2010 YES output), method 2000 proceeds to step 2012, where the control system registers a mode change condition, then returns to step 2004.

Returning to FIG. 4, as long as the input does not manifest a mode change condition (step 56 NO output), method 50 remains in intensity mode 52 and proceeds to step 58. At step 58 the overall intensity of light emitted by the LEDs of the lighting instrument is adjusted according to the input.

In some embodiments, the control system may sample the AC line voltage at a first rate for adjusting the intensity of light emitted by the LEDs and at a second rate for detecting mode change conditions. The second rate is less than the first rate in some embodiments. For example, in some embodiments the first rate is 120 Hz and the second rate is 60 Hz.

In some embodiments, at step 58 the overall intensity of light emitted by the LEDs is adjusted while maintaining the composite color yielded by the light from the LEDs substantially constant. For example, in some embodiments, the controller maintains a constant ratio of driving levels between the LEDs. Alternatively, in some embodiments the control system may determine an absolute color point on a standard scale such as, for example, the 1931 CIE chart (xy) and then adjust the intensity either using repeated calculations, lookup tables or the like to maintain that absolute color point.

In some embodiments, step 56 of monitoring the input and step 58 of adjusting intensity according to the input occur substantially simultaneously. For example, step 56 may be implemented as a background task, such that detection of mode change conditions occurs in parallel with intensity adjustment.

If the input does manifest a mode change condition (step 56 YES output), method 50 enters color mode 60. In some embodiments, method 50 comprises step 63, which adjusts the overall intensity of the light output by the LEDs to a predetermined reference level upon entry into color mode 60. Controlling the LEDs to a reference level upon entry into color control mode may assist a user in obtaining a desired composite color of light from the lamp. A reference level may cause LEDs to emit light having, for example, a predetermined intensity, a predetermined hue, a predetermined saturation, a combination thereof, or the like. For example, LEDs may be controlled to a reference level that causes the LEDs to emit light at a pre-determined percentage the of maximum intensity such as, for example 70% or 50% of the maximum intensity. By establishing the reference level at a value less than the maximum intensity, the overall intensity of light from the LEDs may be kept constant over a relatively large range of AC line voltage conditions and/or physical dimmer switch positions during color mode.

In some embodiments, a reference level is established based on the current color of the composite color of light emitted by the lighting instrument. For example, LEDs may be controlled to a reference level that causes the LEDs to emit light of the current color (e.g., the composite color of the light emitted by the lighting instrument immediately before entering color mode).

In some embodiments, instead of setting the overall intensity to a reference level upon entry into color mode, the overall intensity in the color mode may be determined by the intensity immediately prior to entering the color mode. For example, in some embodiments a delay is implemented between changes to the input value and adjusting the LED output, such that mode change conditions may be detected before the lamp output changes so that the controller can switch to the color mode before the light from the lighting instrument changes. In some embodiments memory is provided to store previous intensity values such that the last intensity value prior to the beginning of the detected mode change conditions can be recalled and used to establish the intensity upon entry to the color mode.

In some embodiments, the control system is configured to set the initial composite color of light from the lighting instrument upon entry to color mode based only on the position of the dimmer switch (and thus the AC line voltage conditions) at the time of color mode entry. In some embodiments, the control system is configured to set the initial composite color of light from the lighting instrument upon entry to color mode to a predetermined reference color. In some embodiments, the control system is configured to set the initial composite color of light from the lighting instrument upon entry to color mode based on the composite color immediately prior to color mode entry.

In embodiments wherein the control system is configured to establish the initial color upon entry to color mode based upon the color immediately prior to entry to color mode, changes in the input may be processed adaptively depending on where in the range the input is. For example, the control may be highly responsive at the end of the range, and less responsive farther from the end of the range, so that the user is guided to "center" the knob (e.g, adjust the dimmer-modulated AC voltage toward the middle of its range).

In some embodiments, the mode change conditions are selected such that the dimmer-modulated AC voltage has a particular duty cycle/amplitude upon entry to the color control mode. For example, in some embodiments, color mode is entered with an AC voltage waveform (knob position) that corresponds to a particular color. In some embodiments, the mode change conditions are selected such that the duty-cycle/amplitude be near the middle of its range (e.g., at least a predetermined difference from either extreme end of the range) upon entry to the color mode.

Upon entry into color mode 60, a color mode timer is reset in step 62, and the input is read at step 64. Thereafter, the color mode timer tracks the amount of time that method 50 has been in color mode 60 without a change in the input. In some embodiments, a mode change signal is optionally provided (e.g. at step 62) upon entry into color mode 60. The mode change signal may comprise, for example, momentarily increasing the power supplied to one or more LEDs to provide a spike in intensity, momentarily reducing the power supplied to one or more LEDs to provide a dip in intensity, modulating the power supplied to one or more LEDs according to a pattern, or the like. Such a signal may alert users to the fact that the user interface can thereafter be used for color control. Such an mode change signal may be particularly useful in embodiments wherein the intensity and/or color is maintained upon entering color mode It will be understood that the inputs read at steps 54 and 64 may be supplied by the same source (e.g., a single dimmer-modulated AC voltage), and that they are shown separately in FIG. 4 to make the explanation of method 50 more easily comprehensible. In some embodiments, the inputs read at steps 54 and 64 are combined into a single physical input. In some embodiments, the inputs read at steps 54 and 64 are implemented as distinct physical inputs. The inputs read at steps 54 and 64 may be sampled at the same rate, or may be sampled at different rates, as discussed above.

In step 66, the input is monitored for change. Whenever the input is changed, the color control mode timer is reset in step 67, and the intensities of the LEDs are adjusted according to the input in step 68. In some embodiments, the intensities of individual ones of the LEDs, or groups of LEDs, are adjusted according to the input such that the composite color yielded by the light from the LEDs is changed while maintaining the overall intensity substantially constant.

In some embodiments, the overall intensity may vary as the color changes. For example, in implementations wherein the LEDs are each driven at a percentage of their maximum driving current, the LEDs may be controlled such that the sum of their percentages is a constant value. The constant value may be, for example 100%. In such embodiments, the overall intensity of light emitted by all of the LEDs may vary as the color changes due to the current response characteristics of the LEDs. For example, some LEDs emit more than 50% of their maximum intensity when driven with 50% of their maximum driving current.

While the input remains unchanged, the color mode timer runs and is monitored in step 70. If method 50 has been in color mode 60 for more than a predetermined time period without a change to the input, method 50 reverts to intensity mode 52. The predetermined time period may be, for example, about 1 second or another time period. Monitoring of color mode timer may be loop-based or interrupt based, for example. In some embodiments, method 50 does not comprise step 70, and the duration of that method 50 stays in color mode 60 is independent of the input.

In some embodiments, method 50 comprises step 72. In step 72, the light emitted from the lamp is controlled to signal the fact that method 50 is returning to intensity control mode 52 from color control mode 60. Such an end color control lamp signal may comprise, for example, momentarily increasing the power supplied to one or more LEDs to provide a spike in intensity, momentarily reducing the power supplied to one or more LEDs to provide a dip in intensity, modulating the power supplied to one or more LEDs according to a pattern, or the like. Such a signal may alert users to the fact that the user interface can thereafter be used for intensity control.

In some embodiments, user interface 13 is operable to cause AC-dimmer 12 to provide a modulated AC voltage that is inadequate to power control system 14 and/or inadequate for control system 14 to provide sufficient power to lighting instrument 17 to deliver lighting. In embodiments where user interface 13 provides limited or no indication of the input value that user interface 13 provides to AC-dimmer 12, a user may inadvertently turn off lighting instrument 17 while attempting to adjust color near one end of the color adjustment range.

Figure 5:
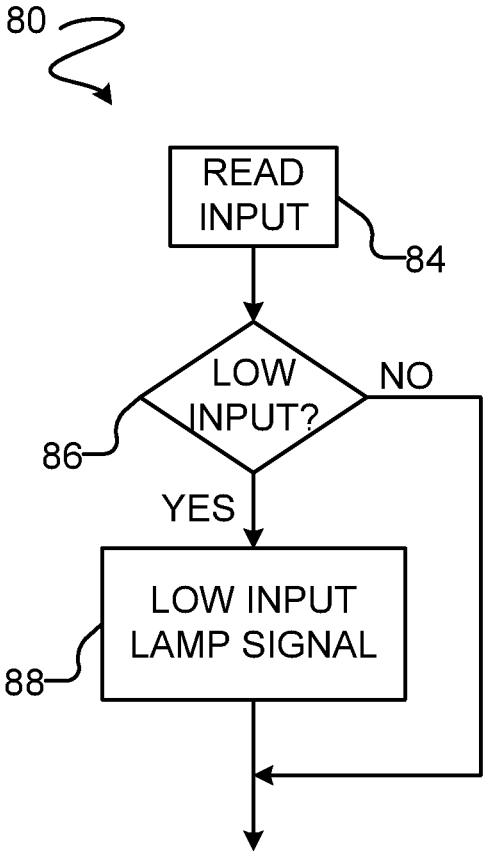
FIG. 5 is a flow chart of a method which may be implemented in a controller for a LED-based illumination apparatus according to an example embodiment.

FIG. 5 shows a method 80 according to an example embodiment which may be implemented in a control system for controlling a lighting instrument, such as, for example, control system 14. In method 80, an input is read at step 84 is checked at step 86 for a low input condition. A low input condition may comprise, for example, a mean AC voltage less than a threshold, AC voltage duty cycle less than a threshold, AC voltage amplitude less than a threshold, or the like. In some embodiments, a low input condition may alternatively or additionally be detected by monitoring the load current in the lighting instrument. For example, in a lighting system with a transformer-based power supply, a low input condition could be indicated by the current in the primary side of a transformer dropping below a predetermined threshold.

If the input exhibits a low input condition (step 86 YES output), method 80 proceeds to step 88. In step 88, the light emitted from the lighting instrument controlled, at least in part, by the input, is modulated to provide a low input warning signal to a user that the input is at a low level. Such a signal may serve as a warning to a user that further adjustment of the input towards the low end of the input range could cause a modulated AC voltage that is inadequate, or nearly inadequate, for powering the lamp and/or the controller, or for proper operation of the lamp and/or the controller.

Method 80 may be integrated with other methods for the control of a lighting instrument, such as, for example, method 50. In particular, method 80 could be implemented between step 54 and step 56, and/or between step 64 and step 66.

A low input warning signal may comprise, for example, a momentary dip in intensity of light emitted from the lighting instrument, a sharp drop in intensity of light emitted from the lighting instrument, a momentary change in the color of light emitted from the lighting instrument, a sharp shift in the color of light emitted from the lighting instrument, a pattern of changes in intensity of light emitted from the lighting instrument (e.g., a sequence of momentary dips in intensity), a momentary spike in intensity (e.g., by providing a capacitor and discharging the capacitor when a low input is detected), or the like.

In some embodiments, the particular low input warning signal provided when a low input is detected may depend on a state of the controller, such as, for example, a current operating mode, a current color setting and/or a current intensity setting. For example, when the controller is in an intensity mode, a low input signal may comprise a change in the color of light emitted by the lighting instrument to a color that is the complement of the color currently emitted by the lighting instrument. A color change may also be used as a low input signal in the color mode in some embodiments. In some embodiments, when the controller is in a color mode, a low input signal comprises a change in intensity, such as, for example, a sharp drop in intensity. In some embodiments, the low input signal may comprise both a change in intensity and a change in color.

Figure 6:
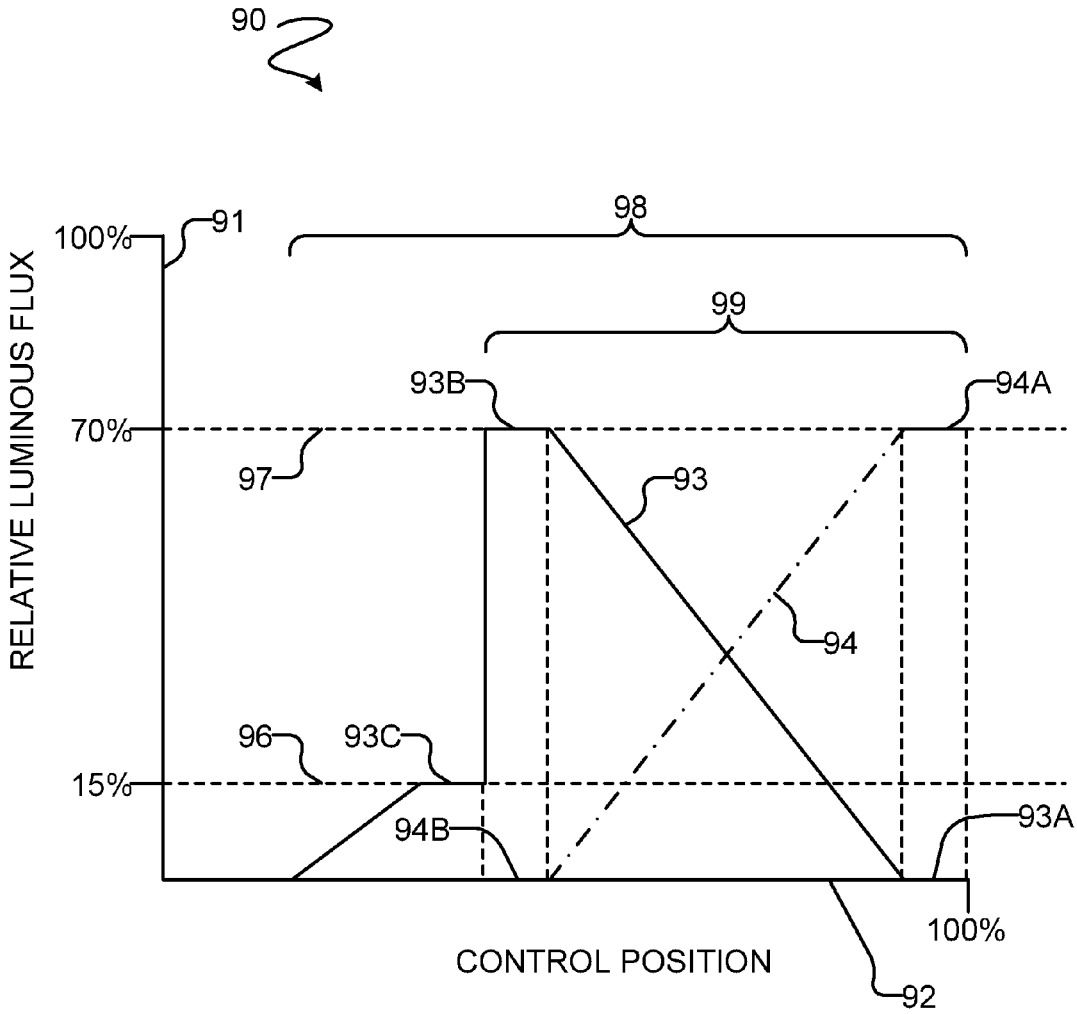
FIG. 6 is a graph showing control of a two color LED-based illumination apparatus according to an example embodiment.

FIG. 6 shows a graph 90 of control of a lighting instrument in a color control mode according to an example embodiment. The FIG. 6 example may be implemented using a lighting instrument having two LEDs of different colors. For example, the lighting instrument could have two different colors of white LED (e.g. Warm White (2700K) and Cold White (3500K)). The control illustrated in graph 90 may be implemented, for example, in step 68 of method 50.

In graph 90, the relative luminous flux of light emitted from LEDs is plotted along vertical axis 91 and the position of a user control for an AC-dimmer is plotted along horizontal axis 92. Control position movement to the right along the range of horizontal axis 92 corresponds to increasing power from dimmer-modulated AC voltages. Line 93 represents the luminous flux of a first color LED controlled based on the dimmer-modulated AC voltage specified by the control position. Line 94 represents the luminous flux of a second color LED controlled based on the dimmer-modulated AC voltage specified by the control position. In the FIG. 6 embodiment, the lighting instrument emits light of the first color at a low end of the range, and emits light of the second color at a high end of the range.

Operational range 98 corresponds to a range of dimmer-modulated AC voltages for which the controller is able to operate to reliably drive the first and second color LEDs in accordance with input specified by the user control. For control positions below the lower extent of operational range 98, the power from corresponding dimmer-modulated AC voltages is inadequate to operate the controller reliably. A preferred operating range 99 lies within operational range 98.

Different control positions correspond to different balances between the luminous flux of the first and second color LEDs. Throughout preferred operating range 99, the sum of the luminous flux from the first color LED and second color LED is constant at an operating range luminous flux maximum 97. In the embodiment illustrated by graph 90, the operating range luminous flux maximum is 70% of the maximum luminous flux. In some embodiments the 'maximum' luminous flux is specified as the lower of the two maximums that the LEDs can output.

At the upper end of the control position range, the luminous flux of the second color LED 94 plateaus 94A at operating range luminous flux maximum 97. At the upper end of the control position range, the luminous flux of the first color LED 93 plateaus 93A at zero. In some embodiments, plateau 93A may be selected to have a level above zero (e.g., in order to limit the color gamut). Luminous flux plateaus 93A and 94A at the upper end of the control position range may serve to indicate to a user operating the control that the control position is nearing the upper extent of its range. This may be useful in embodiments where user interface 13 provides limited or no visual indication of control position to the user (e.g., where user interface 13 comprises a featureless, radially symmetric knob). In some embodiments, luminous flux plateaus 93A and 94A at the upper end of the control position range may be omitted. In some embodiments, other signal patterns may be provided instead of plateaus 93A and 94A to indicate to the user that the control position is nearing the upper extent of its range.

At the lower end of preferred operating range 99, the luminous flux of the first color LED 93 plateaus 93B at operating range luminous flux maximum 97. At the lower end of preferred operating range 99, the luminous flux of the second color LED 94 plateaus 94B at zero. In some embodiments, plateau 94B may be selected to have a level above zero (e.g., in order to limit the color gamut). Luminous flux plateaus 93B and 94B at the lower end of preferred operating range 99 may serve to indicate to a user operating the control that the control position is nearing the lower extent of the preferred operating range. The user may thereby be warned that if the control position continues to be moved toward the lower end of the control position range, the controller may stop operating or may stop operating properly, which could cause the lighting instrument to turn off or behave in a manner other than intended. In some embodiments, other signal patterns may be provided instead of plateaus 93B and 94B to indicate to the user that the control position is nearing the lower extent of the preferred range.

As the control position decreases beyond the lower extent of preferred operating range 99, the luminous flux of the first color LED 93 drops sharply to a plateau 93C at a luminous flux warning level 96. Warning level 96 may, for example, be approximately 15% of the maximum luminous flux. Such a sharp drop in luminous flux may serve to indicate to a user operating the control that the control position is outside of preferred operating range 99 and nearing the lower extent of operational range 98. The user may thereby be warned that if the control position continues to be moved toward the lower end of the control position range, the controller and/or the lighting instrument may stop operating, or may stop operating properly.

As the control position continues to move toward the lower extent of operational range 98, the luminous flux of the first color LED 93 is reduced to zero. At the lower extent of operational range 98 outside of preferred range 99, the luminous flux may, for example, be the maximum achievable when the control is at that position. In the illustrated embodiment, the luminous flux of the first color LED 93 reaches zero at the lower extent of the operational range. In some embodiments, user interface 13 and/or dimmer 12 are configured to prevent adjustment of the AC line voltage to zero, such that some predetermined minimum power is always present.

The configuration of preferred operating range 99, operational range 98, operating range luminous flux maximum 97 and luminous flux warning level 96 may be adjusted to suit particular conditions of an LED lighting environment or system. For example, the ranges and levels may be selected based on the characteristics of the LEDs and the maximum power available from the AC line. For example, some embodiments may trade off a higher selected operating range luminous flux maximum 97 for a narrower preferred operating range 99. In some embodiments, selecting the operating range luminous flux maximum 97 to be 70% or greater may be desirable because that is a value to which a human will often not notice a light intensity dropping. In other embodiments, the operating range luminous flux maximum 97 could have different values, such as, for example 60% or 85%.

One skilled in the art will note from the above that a 50% dimmer switch position does not limit the lamp to 50% luminous flux or 50% current. In some embodiments, the power supply is "over specified" for a particular implementation such that the operating range luminous flux maximum 97 may be 100% of the overall maximum and a satisfactory width of preferred operating range 99 may be maintained.

Figure 7:
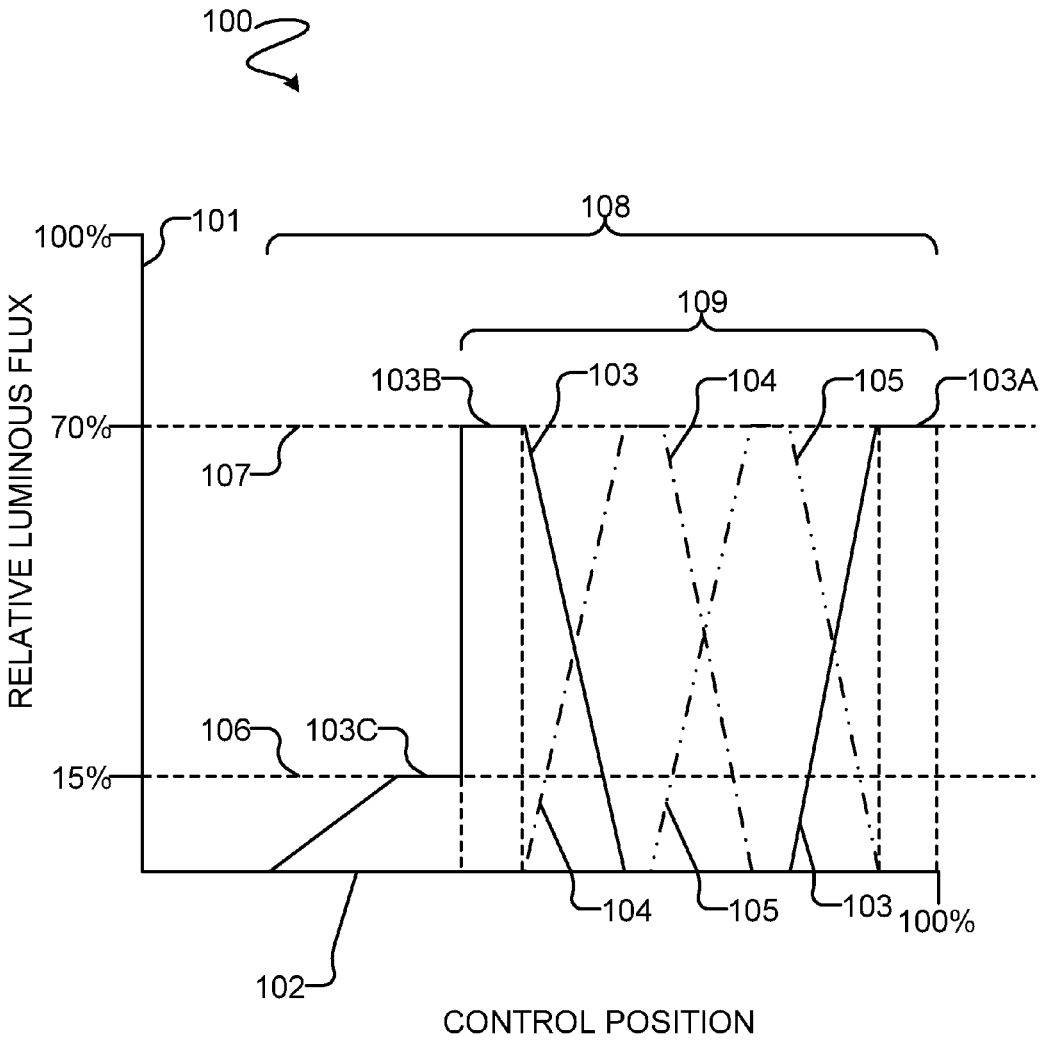
FIG. 7 is a graph showing control of a three color LED-based illumination apparatus according to an example embodiment.

FIG. 6 shows an example wherein LEDs of two different colors are controlled. LEDs of more than two different colors may also be controlled with techniques similar to those discussed above. For example, FIG. 7 shows a graph 100 of control of a lighting instrument having three LEDs of different colors in a color control mode according to an example embodiment. For example, the lighting instrument could have a red LED, a green LED and a blue LED. The control illustrated in graph 100 may be implemented, for example, in step 68 of method 50.

In graph 100, the relative luminous flux of light emitted from LEDs is plotted along vertical axis 101 and the position of a user control for an AC-dimmer is plotted along horizontal axis 102. Control position movement to the right along the range of horizontal axis 102 corresponds to increasing power from dimmer-modulated AC voltages. Line 103 represents the luminous flux of a first color LED controlled based on the dimmer-modulated AC voltage specified by the control position. Line 104 represents the luminous flux of a second color LED controlled based on the dimmer-modulated AC voltage specified by the control position. Line 105 represents the luminous flux of a third color LED controlled based on the dimmer-modulated AC voltage specified by the control position. Plateaus 103A and 103B at a reference level 107 are provided for the first color LED at the ends of a preferred operating range 109. Another plateau 103C is provided at a warning level 106 outside of preferred operating range 109 but within operational range 108, similar to the FIG. 6 embodiment discussed above.

In the FIG. 7 embodiment, the lighting instrument emits light of the first color at both the low and high ends of the range, and emits light of the second and third colors at intermediate portions of range. In the FIG. 7 embodiment, when the first color is blue, the second color is green and the third color is red, movement of the control position through preferred operating range causes the composite color of light to cycle through the saturated colors (e.g. Blue, Cyan, Green, Yellow, Red, Magenta, Blue) and would not produce white light. In other embodiments, more complex control schemes may be implemented to produce white light and/or to cycle through the full possible color gamut. Also, in some embodiments the lighting instrument has LEDs of more than three different colors.

Figure 8:
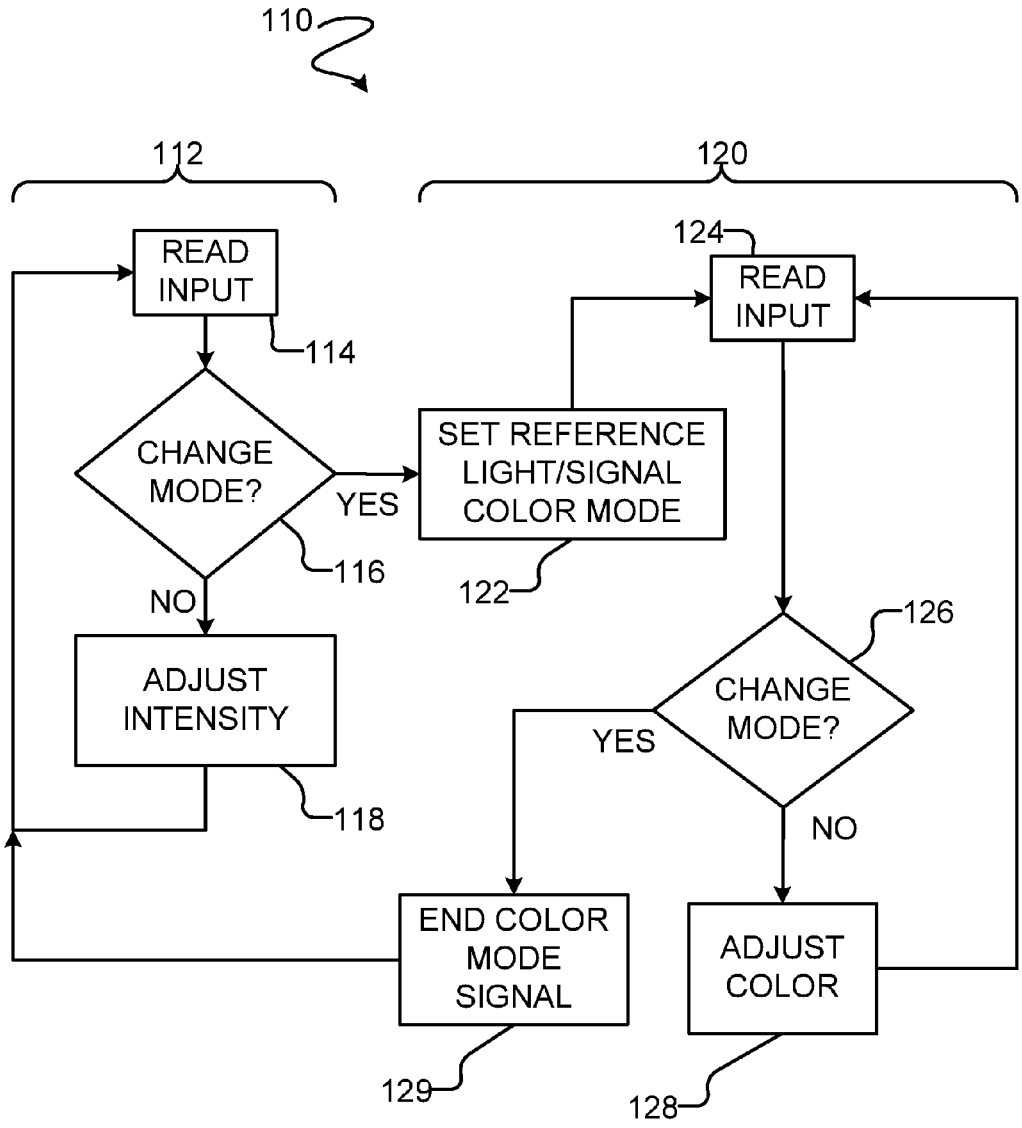
FIG. 8 is a flow chart of a method for controlling a LED-based illumination apparatus according to an example embodiment.

FIG. 8 shows a method 110 according to an example embodiment, which a control system for a LED-based illumination apparatus (such as, for example, control system 14) may be configured to execute. Method 110 comprises an intensity mode 112 and a color mode 120. In intensity mode 112, an input is read at step 114 and monitored at step 116 to determine if the input manifests a mode change condition. Detection of mode change conditions in method 110 may be the same as or similar to detection of mode change conditions as described above with respect to method 50.

As long as the input does not manifest a mode change condition (step 116 NO output), method 110 remains in intensity mode 112 and proceeds to step 118. At step 118 the overall intensity of light emitted by the LEDs of the lighting instrument is adjusted according to the input. Adjustment of intensity at step 118 may be the same as or similar to the adjustment at step 58 of method 50 as described above.

If the input does manifest a mode change condition (step 116 YES output), method 110 enters color mode 120. In some embodiments, method 110 comprises step 122, wherein the overall intensity of the light output by the LEDs is set to a predetermined reference level upon entry into color mode 120. Alternatively or additionally, step 122 may comprise operating the LEDs to provide a mode change signal (e.g., a momentary dip or spike in intensity, a change in color, a predetermined light pattern, etc.) upon entry into color mode 120.

In color mode 120, the input is read at step 124 and at step 126 the input is monitored to determine if the input manifests a mode change condition. If no mode change conditions are detected (step 126 NO output), method 110 proceeds to step 128 wherein the intensities of the LEDs are adjusted according to the input to vary the composite color of light emitted from the lighting instrument. Adjustment of composite color at step 128 may be the same as or similar to the adjustment at step 68 of method 50 as described above.

If a mode change condition is detected (step 126 YES output), method 110 proceeds to step 129 wherein the LEDs are operated to provide a signal indicating the end of color mode 120 and the return to intensity mode 112. Signaling of the mode change at step 129 may be the same as or similar to the signaling at step 72 of method 50 as described above.

Figure 9:
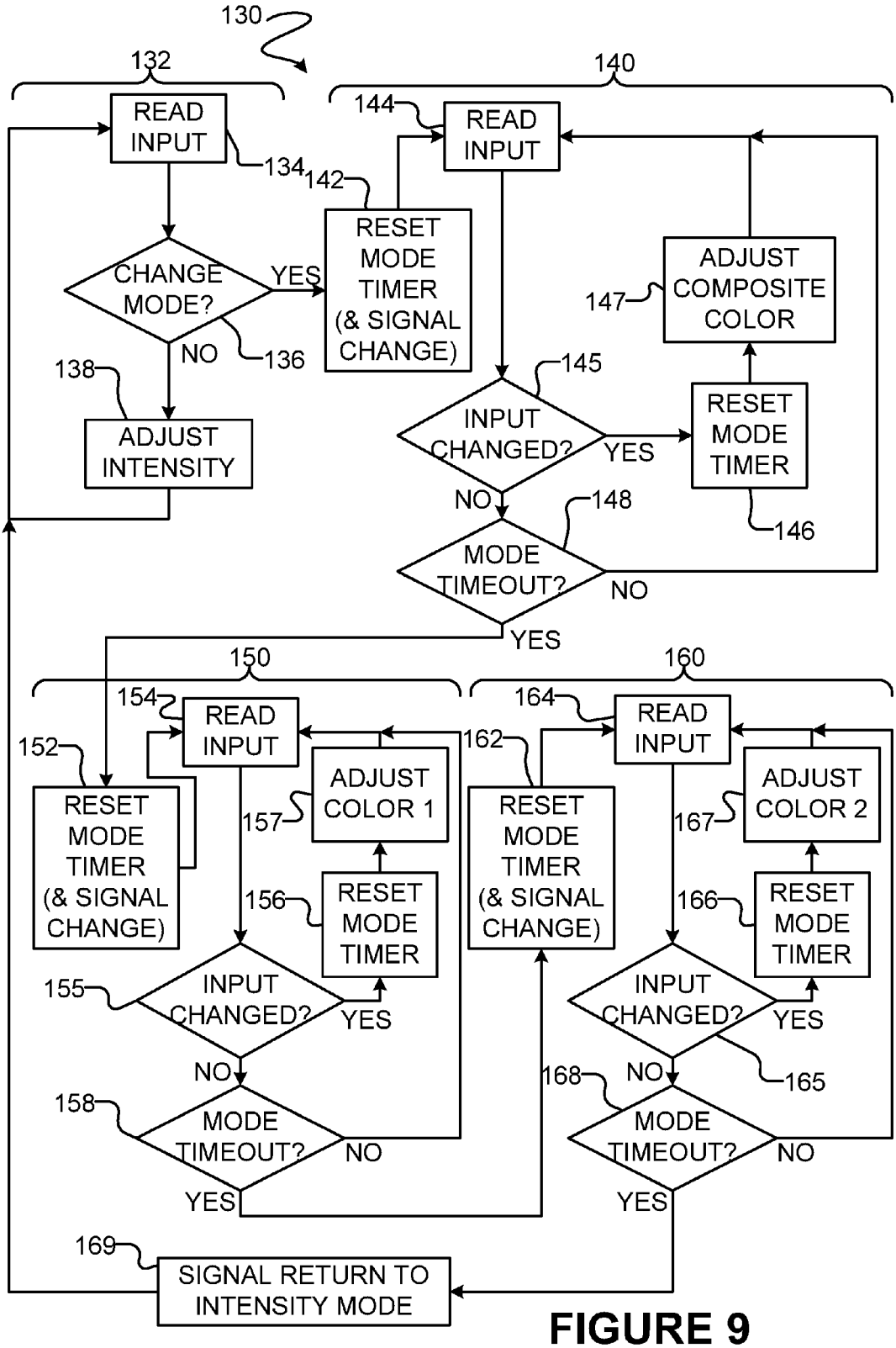
FIG. 9 is a flow chart of a method for controlling a LED-based illumination apparatus according to an example embodiment.

FIG. 9 shows a method 130 according to an example embodiment, which a control system for a LED-based illumination apparatus (such as, for example, control system 14) may be configured to execute. Method 130 comprises an intensity mode 132, a composite color mode 140, a first color adjustment mode 150 and a second color adjustment mode 160. In intensity mode 132, an input is read at step 134 and monitored at step 136 to determine if the input manifests a mode change condition. Detection of mode change conditions in method 130 may be the same as or similar to detection of mode change conditions as described above with respect to method 50.

As long as the input does not manifest a mode change condition (step 136 NO output), method 130 remains in intensity mode 132 and proceeds to step 138. At step 138 the overall intensity of light emitted by the LEDs of the lighting instrument is adjusted according to the input. Adjustment of intensity at step 138 may be the same as or similar to the adjustment at step 58 of method 50 as described above.

If the input does manifest a mode change condition (step 136 YES output), method 130 enters composite color mode 140 and proceeds to step 142. In step 142, a mode timer is reset. The mode timer tracks the amount of time that method 130 has been in the composite color mode 140 without a change in the input. In some embodiments, step 142 also comprises signaling a mode change, as discussed above. In some embodiments step 142 also comprises adjusting the overall intensity of the light output by the LEDs to a predetermined reference level upon entry into composite color mode 140.

In step 144 the input is read, and in step 145 the input is monitored for change. Whenever the input is changed (step 145 YES output), the mode timer is reset in step 146, and the composite color of light from the LEDs is adjusted according to the input in step 147. Adjusting the composite color at step 147 may be the same as or similar to the adjustment at step 68 of method 50 as described above.

While the input remains unchanged, the mode timer runs and is monitored in step 148. If method 130 has been in composite color mode 140 for more than a predetermined timeout period without a change to the input, method 130 enters the first color adjustment mode 150 and proceeds to step 152.

In step 152, the mode timer is reset. The mode timer tracks the amount of time that method 130 has been in first color adjustment mode 150 without a change in the input. Step 152 may also comprise storing the last composite color selected in composite color mode 140 in memory. In some embodiments, step 152 also comprises signaling a mode change, as discussed above. In some embodiments, signaling entry into first color adjustment mode 150 may comprise momentarily causing the lighting instrument to output light of only the first color (for example, by temporarily turning off LEDs of any color other than the first color), or may comprise any suitable way to signal mode change, then returning to the last composite color selected in mode 140.

In step 144 the input is read and in step 155 the input is monitored for change. Whenever the input is changed (step 155 YES output), the mode timer is reset in step 156, and the intensity of the first color of light from the LEDs is adjusted according to the input in step 157. In some embodiments, adjustment of the first color in first color adjustment mode 150 is limited to a relatively narrow range around the intensity of the first color in the last composite color selected in mode 140. For example, in some embodiments, adjustment of the first color may be limited to a range which is within a predetermined difference (e.g. +– a predetermined percent, +– a predetermined number of lumens, etc.) from the intensity of the first color in the last composite color selected in mode 140. In some embodiments, changes in the input may be processed adaptively in first color adjustment mode 150 depending on where in the range the input is. For example, the control may be highly responsive at the end of the range, and less responsive farther from the end of the range, so that the user is guided to "center" the knob (e.g, adjust the dimmer-modulated AC voltage toward the middle of its range).

While the input remains unchanged, the mode timer runs and is monitored in step 158. If method 130 has been in first color adjustment mode 150 for more than a predetermined timeout period without a change to the input, method 130 enters second color adjustment mode 160 and proceeds to step 162. The predetermined timeout period for first color adjustment mode 150 may be the same as or different from the predetermined timeout period for composite color mode 140.

In step 162, the mode timer is reset. The mode timer tracks the amount of time that method 130 has been in second color adjustment mode 160 without a change in the input. Step 162 may also comprise storing the last composite color selected in composite color mode 140, as adjusted in first color adjustment mode 150, in memory. In some embodiments, step 162 also comprises signaling a mode change, as discussed above. In some embodiments, signaling entry into second color adjustment mode 160 may comprise momentarily causing the lighting instrument to output light of only the second color (for example, by temporarily turning off LEDs of any color other than the second color), or may comprise any suitable way to signal mode change, then returning to the last composite color selected (e.g. the color selected in mode 140 as modified in mode 150).

In step 164 the input is read and in step 165 the input is monitored for change. Whenever the input is changed (step 165 YES output), the mode timer is reset in step 166, and the intensity of the second color of light from the LEDs is adjusted according to the input in step 167. Adjustment of the second color in mode 160 may be the same as or similar to adjustment of the first color in mode 150, as described above.

While the input remains unchanged, the mode timer runs and is monitored in step 168. If method 130 has been in second color adjustment mode 160 for more than a predetermined timeout period without a change to the input, method 130 proceeds to step 169. The predetermined timeout period for second color adjustment mode 160 may be the same as or different from the predetermined timeout periods for composite color mode 140 and/or first color adjustment mode 150. At step 169, a signal indicating the return to intensity mode 132 is provided, then method returns to intensity mode 132.

The example of FIG. 9 illustrates individual adjustment of two colors after selecting a composite color, but it is to be understood that any number of colors may be adjusted by providing additional color adjustment modes after second color adjustment mode 160. For example, if the lighting instrument comprises LEDs of three different colors, method 130 may include a third color adjustment mode, and so on. Also, it is to be understood that although the mode changes from composite color mode 140 and the color adjustment modes 150 and 160 are effected by timeouts in the FIG. 9 example, one or more of such mode changes may be effected by detection of mode change conditions in other embodiments. Also, in some embodiments, the control system may be configured to return directly to the intensity mode upon the occurrence of a mode timeout or mode change conditions if no adjustments are made in a color adjustment mode.

Figure 9A:
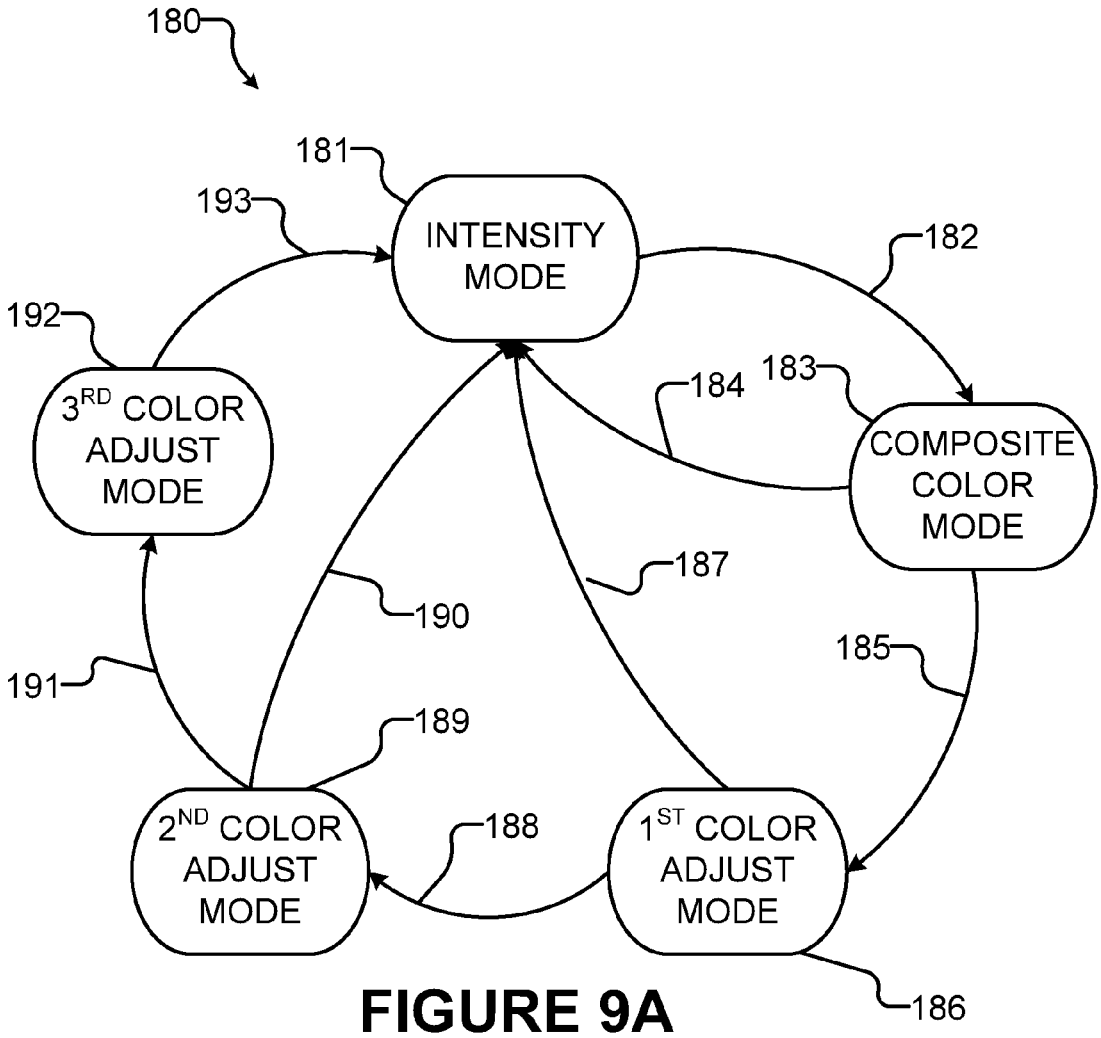
FIG. 9A is a state diagram illustrating the operation of a control system for a LED-based illumination apparatus according to an example embodiment.

FIG. 9A shows a state diagram 180 which illustrates the operation of a control system implementing a method according to an example embodiment. The control system is initially in an intensity mode 181, and remains in intensity mode 181 until the occurrence of a mode change condition. When a mode change condition is detected, the control system switches (line 182) to a composite color mode 183. The control system stays in composite color mode 183 until the occurrence of a mode timeout or a mode change condition. If a mode timeout or mode change condition occurs and no adjustments to the color have been made in mode 183, the control system switches (line 184) to intensity mode 181. If a mode timeout or mode change condition occurs and adjustments to the color have been made, the control system switches (line 185) to first color adjustment mode 186. The control system stays in first color adjustment mode 186 until a mode timeout or mode change condition occurs. If a mode timeout or mode change condition occurs and no adjustment has occurred in mode 186, the control system switches (line 187) to intensity mode 181. If a mode timeout or mode change condition occurs and adjustment has occurred, the control system switches (line 188) to second color adjustment mode 189. The control system stays in second color adjustment mode 189 until a mode timeout or mode change condition occurs. If a mode timeout or mode change condition occurs and no adjustment has occurred in mode 189, the control system switches (line 190) to intensity mode 181. If a mode timeout or mode change condition occurs and adjustment has occurred, the control system switches (line 191) to third color adjustment mode 192. The control system stays in third color adjustment mode 192 until a mode timeout or mode change condition occurs, at which point the control system switches (line 193) to intensity mode 351.

Figure 10:
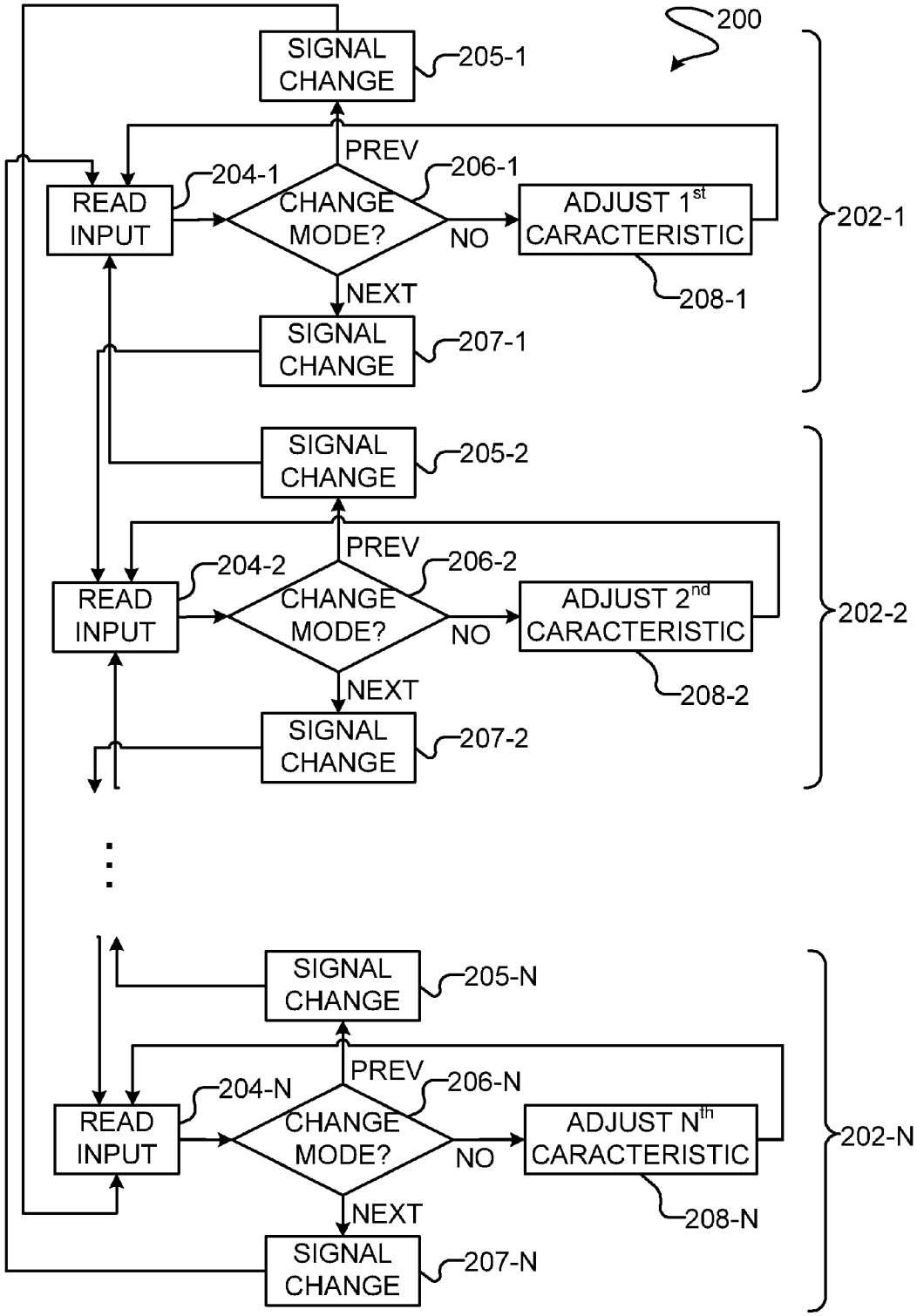
FIG. 10 is a flow chart of a method for controlling a LED-based illumination apparatus according to an example embodiment.

FIG. 10 shows a method 200 according to an example embodiment, which a control system for a LED-based illumination apparatus (such as, for example, control system 14) may be configured to execute. Method 200 comprises a plurality of modes 202-1 to 202-N, each of which controls a different characteristic of light emitted from a lighting instrument having a plurality of LEDs. In the FIG. 10 example, modes 202-1 to 202-N each operate in the substantially same way, are described generally below the suffix -x in place of the suffixes -1, -2, etc. of the reference numerals shown in FIG. 10.

In each mode 202-*x* an input is read at step 204-*x*, and the input is monitored for mode change conditions at step 206-*x*. In method 200, the control system is configured to monitor for and differentiate between two types of mode change conditions: a next mode change condition and a previous mode change condition. The next and previous mode change conditions may comprise any of a variety of conditions of dimmer modulated AC line voltage, as described above with respect to method 50. In some embodiments, the next and previous mode change conditions comprise complementary patterns of transitions of a parameter across a threshold. For example, the next mode change condition may comprise transitioning from below to above to below to above to below a threshold within a predetermined time period, and the previous mode change condition may comprise transitioning from above to below to above to below to above a threshold within a predetermined time period. In some embodiments, different thresholds may be used for detecting upward and downward transitions, wherein a slightly higher threshold is used for detecting upward transitions and a slightly lower threshold is used for detecting downward transitions. In some embodiments, the threshold level may be selected based on the current value of the parameter of the AC line voltage, such that a user may trigger a mode change by performing the same pattern of actions regardless of the current position of the user interface.

If no mode change conditions are detected (step 206-*x* NO output), method 200 proceeds to step 208-*x* where the characteristic of light from a lighting instrument corresponding to mode 202-*x* is adjusted based on changes to the input. For example, in each mode 202-*x* the control system could be configured to adjust one or more of:

- the overall intensity of light from the lighting instrument;
- the composite color of light from the lighting instrument;
- the intensity of all of the LEDs of one or more particular colors in the lighting instrument;
- the intensity of some of the LEDs of one or more particular colors in the lighting instrument;
- the intensity of specific ones or groups of the LEDs;
- a flashing and/or pulsing pattern of light from a lighting instrument; and/or
- a rate at which the flashing/pulsing pattern repeats, in response to changes in AC line voltage conditions.

If a next mode change condition is detected (step 206-*x* NEXT output), method 200 proceeds to signal a mode change at step 207-*x* and then proceed to the next mode in the sequence of modes 202-1 to 202-N. Changing to the next mode from the last mode 202-N returns to the first mode 202-1. Signaling the mode change at step 207-*x* may comprise any desired adjustment of light from the lighting instrument, as discussed above. In some embodiments, signaling the mode change to the next mode at step 207-*x* comprises generating a signal which is particular to the mode being entered.

If a previous mode change condition is detected (step 206-*x* PREV output), method 200 proceeds to signal a mode change at step 205-*x* and then proceed to the previous mode in the sequence of modes 202-1 to 202-N. Changing to the previous mode from the first mode 202-1 returns to the last mode 202-N. Signaling the mode change at step 205-*x* may comprise any desired adjustment of light from the lighting instrument, as discussed above. In some embodiments, signaling the mode change to the previous mode at step 205-*x* comprises generating a signal which is particular to the mode being entered.

Figure 11:
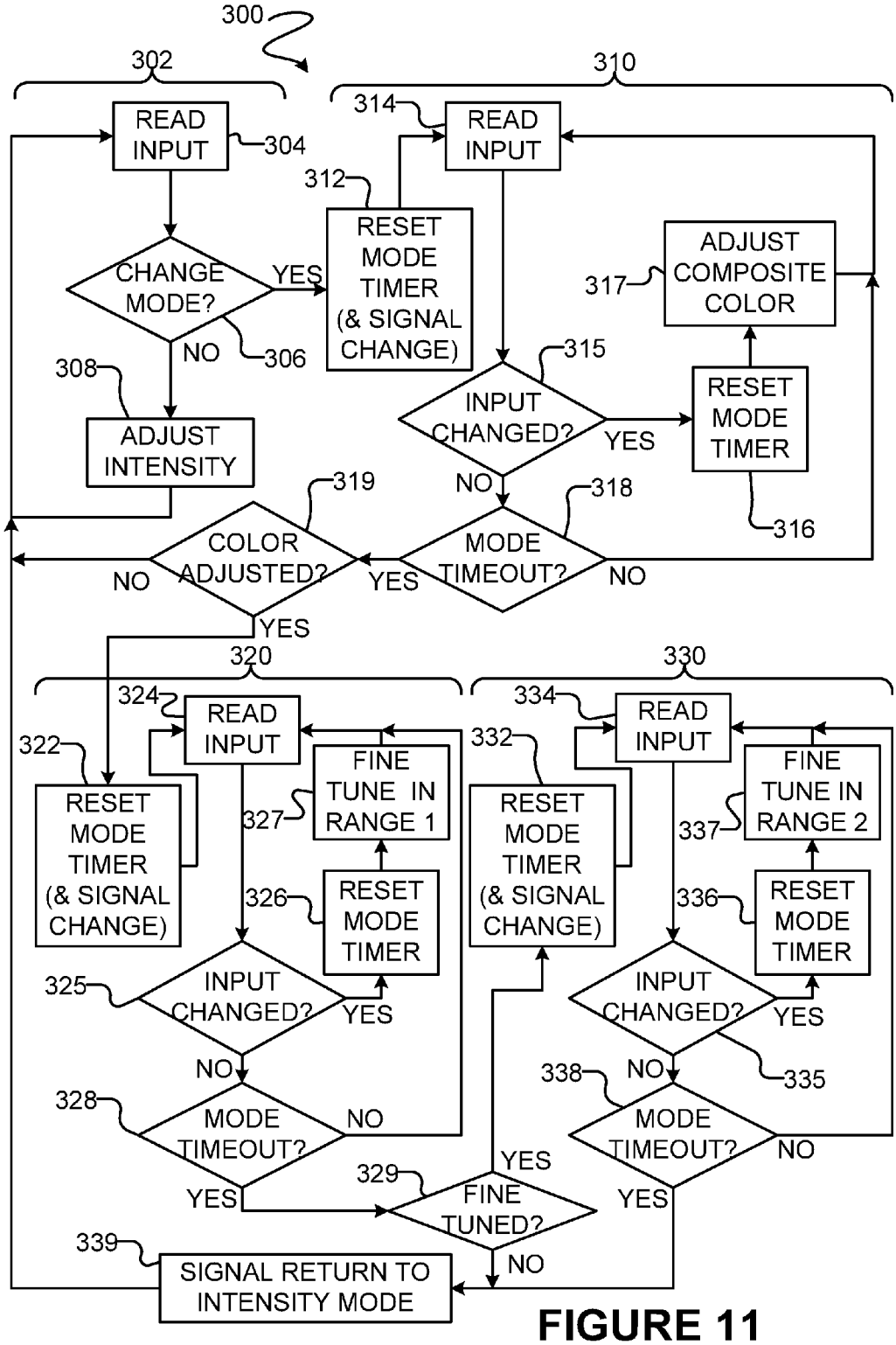
FIG. 11 is a flow chart of a method for controlling a LED-based illumination apparatus according to an example embodiment.

FIG. 11 shows a method 300 according to an example embodiment, which a control system for a LED-based illumination apparatus (such as, for example, control system 14) may be configured to execute. Method 300 comprises an intensity mode 302, a composite color mode 310, a first fine tuning mode 320 and a second fine tuning mode 330. In intensity mode 302, an input is read at step 304 and monitored at step 306 to determine if the input manifests a mode change condition. Detection of mode change conditions in method 300 may be the same as or similar to detection of mode change conditions as described above with respect to method 50.

As long as the input does not manifest a mode change condition (step 306 NO output), method 300 remains in intensity mode 302 and proceeds to step 308. At step 308 the overall intensity of light emitted by the LEDs of the lighting instrument is adjusted according to the input. Adjustment of intensity at step 308 may be the same as or similar to the adjustment at step 58 of method 50 as described above.

If the input does manifest a mode change condition (step 306 YES output), method 300 enters composite color mode 310 and proceeds to step 312. In step 312, a mode timer is reset. The mode timer tracks the amount of time that method 300 has been in the composite color mode 310 without a change in the input. In some embodiments, step 312 also comprises signaling a mode change, as discussed above. In some embodiments step 312 also comprises adjusting the overall intensity of the light output by the LEDs to a predetermined reference level upon entry into composite color mode 310.

In step 314 the input is read, and in step 315 the input is monitored for change. Whenever the input is changed (step 315 YES output), the mode timer is reset in step 316, and the composite color of light from the LEDs is adjusted according to the input in step 317. Adjusting the composite color at step 317 may be the same as or similar to the adjustment at step 68 of method 50 as described above.

While the input remains unchanged, the mode timer runs and is monitored in step 318. If method 300 has been in composite color mode 310 for more than a predetermined timeout period without a change to the input, method 300 enters the first fine tuning mode 320 and proceeds to step 322.

In some embodiments, method 300 comprises an additional step 319 between steps 318 and 322. In step 319, the control system determines if any adjustments to the composite color were made in composite color mode 310. If no adjustments to the composite color were made (step 319 NO output), method returns to intensity mode 302. A signal indicating return to intensity mode 302 may also be provided. In such embodiments, method 300 only proceeds to first fine tuning mode 320 if the color was adjusted in composite color mode 310 (step 319 YES output).

In step 322, the mode timer is reset. The mode timer tracks the amount of time that method 300 has been in first fine tuning mode 150 without a change in the input. Step 322 may also comprise storing the last composite color selected in composite color mode 310 in memory. In some embodiments, step 322 also comprises signaling a mode change, as discussed above. Signaling entry into first fine tuning mode 320 may comprise any suitable way to signal mode change.

In step 324 the input is read and in step 325 the input is monitored for change. Whenever the input is changed (step 325 YES output), the mode timer is reset in step 326, and the composite color of light from the LEDs is adjusted within a first fine tuning range according to the input in step 327. In some embodiments, adjustment of the composite color in first fine tuning mode 320 comprises keeping the overall intensity substantially constant. The first fine tuning range is smaller than the complete range of adjustment available in step 317 of composite color mode 310. In some embodiments, a lower bound of the first fine tuning range is selected based on the last composite color selected in mode 310. In some embodiments, an upper bound of the first fine tuning range is selected based on the last composite color selected in mode 310. In some embodiments, both the lower and upper bounds of the first fine tuning range are selected based on the last composite color selected in mode 310. For example, in some embodiments, adjustment of the composite color may be limited to a range which is within a predetermined difference from the last composite color selected in mode 310.

While the input remains unchanged, the mode timer runs and is monitored in step 328. If method 300 has been in first fine tuning mode 320 for more than a predetermined timeout period without a change to the input, method 300 enters second fine tuning mode 330 and proceeds to step 332. The predetermined timeout period for first fine tuning mode 320 may be the same as or different from the predetermined timeout period for composite color mode 310.

In some embodiments, method 300 comprises an additional step 329 between steps 328 and 332. In step 329, the control system determines if any fine tuning of the composite color occurred in first fine tuning mode 320. If the composite color was not fine tuned (step 319 NO output), method proceeds to step 339 where a signal indicating the return to intensity mode 302 is provided, then method returns to intensity mode 302. In such embodiments, method 300 only proceeds to second fine tuning mode 330 if the composite color was fine tuned in first fine tuning mode 320 (step 329 YES output).

In step 332, the mode timer is reset. The mode timer tracks the amount of time that method 300 has been in second fine tuning mode 330 without a change in the input. Step 332 may also comprise storing the last composite color selected in composite color mode 310, as adjusted in first fine tuning mode 320, in memory. In some embodiments, step 332 also comprises signaling a mode change, as discussed above. Signaling entry into second fine tuning mode 330 may comprise any suitable way to signal mode change.

In step 334 the input is read and in step 335 the input is monitored for change. Whenever the input is changed (step 335 YES output), the mode timer is reset in step 336, and the composite color of light from the LEDs is adjusted within a second fine tuning range according to the input in step 337. In some embodiments, adjustment of the composite color in second fine tuning mode 330 comprises keeping the overall intensity substantially constant. The second fine tuning range is smaller than the first fine tuning range of mode 320. In some embodiments, a lower bound of the second fine tuning range is selected based on the last composite color selected in mode 320. In some embodiments, an upper bound of the second fine tuning range is selected based on the last composite color selected in mode 320. In some embodiments, both the lower and upper bounds of the second fine tuning range are selected based on the last composite color selected in mode 320. For example, in some embodiments, adjustment of the composite color may be limited to a range which is within a predetermined difference from the last composite color selected in mode 320.

While the input remains unchanged, the mode timer runs and is monitored in step 338. If method 300 has been in second fine tuning mode 330 for more than a predetermined timeout period without a change to the input, method 300 proceeds to step 339. The predetermined timeout period for second color fine tuning mode 330 may be the same as or different from the predetermined timeout periods for composite color mode 310 and/or first fine tuning mode 320. At step 339, a signal indicating the return to intensity mode 302 is provided, then method returns intensity mode 302.

The example of FIG. 11 illustrates fine tuning the composite color within two increasingly narrow ranges (thereby providing increasing sensitivity) after selecting an initial composite color, but it is to be understood that any number additional fine tuning modes could be provided. Also, it is to be understood that although the mode changes from composite color mode 310 and the fine tuning modes 320 and 330 are effected by timeouts in the FIG. 11 example, one or more of such mode changes may be effected by detection of mode change conditions in other embodiments.

Figure 12:
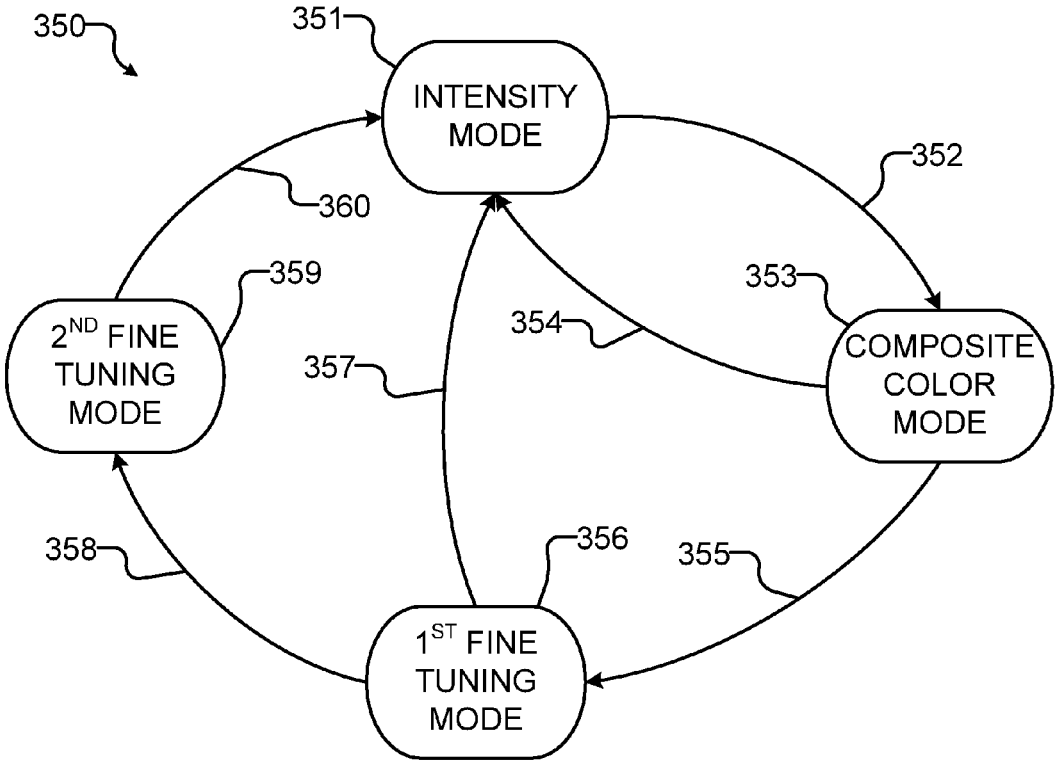
FIG. 12 is a state diagram illustrating the operation of a control system for a LED-based illumination apparatus according to an example embodiment.

FIG. 12 shows a state diagram 350 which further illustrates the operation of a control system implementing a method according to an example embodiment. The control system is initially in an intensity mode 351, and remains in intensity mode 351 until the occurrence of a mode change condition. When a mode change condition is detected, the control system switches (line 352) to a composite color mode 353. The control system stays in composite color mode 353 until a mode timeout or mode change condition occurs. If a mode timeout or mode change condition occurs and no adjustments to the color have been made in mode 353, the control system switches (line 354) to intensity mode 351. If a mode timeout or mode change condition occurs and adjustments to the color have been made, the control system switches (line 355) to first fine tuning mode 356. The control system stays in first fine tuning mode 356 until a mode timeout or mode change condition occurs. If a mode timeout or mode change condition occurs and no fine tuning has occurred in mode 356, the control system switches (line 357) to intensity mode 351. If a mode timeout or mode change condition occurs and fine tuning has occurred, the control system switches (line 358) to second fine tuning mode 359. The control system stays in second fine tuning mode 359 until a mode timeout or mode change condition occurs, at which point the control system switches (line 360) to intensity mode 351.

Figure 13:
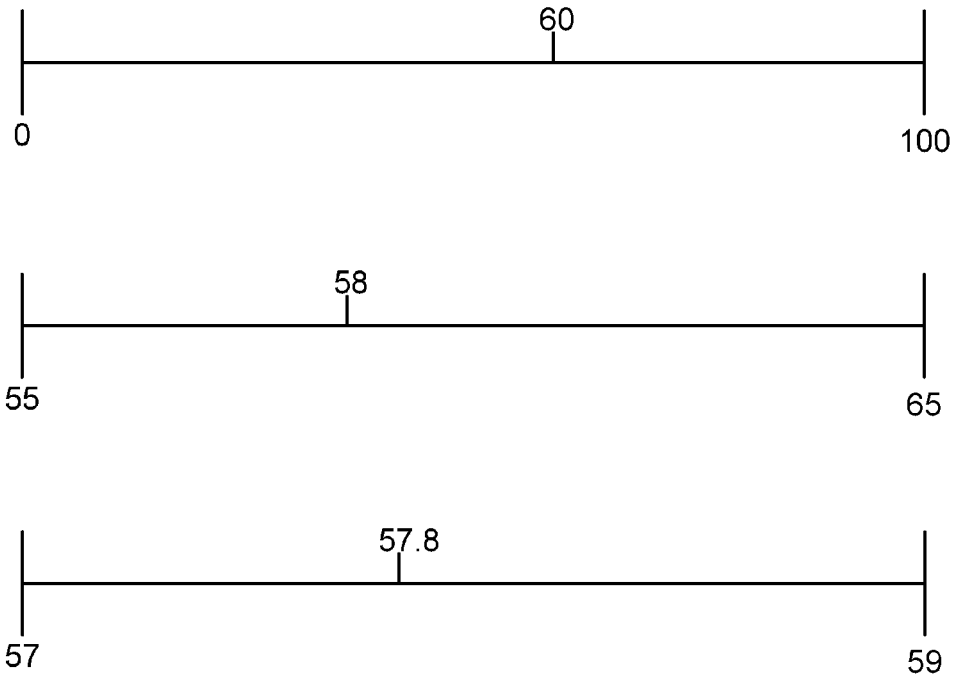
FIG. 13 shows example adjustment ranges according to an example embodiment.

FIG. 13 graphically illustrates example adjustment ranges in a method such as method 300 comprising a composite color mode and first and second fine tuning modes. The top graph shows an adjustment range for the composite color mode, wherein the user interface is operable to select a full range of available colors (the full range is shown as 0-100 in FIG. 13, but it is to be understood that these represent arbitrary units for designating colors, and any number of different colors could be selectable). In the FIG. 13 example, the user selects a color value of 60 in the composite color mode, and then the control system switches to the first fine tuning mode. The first fine tuning range is selected based on the color value from the composite color mode, wherein the user interface is operable to select color values between 55 and 65 (FIG. 13 shows the first fine tuning range centered on the color value from the composite color mode, but this is not required in all embodiments). In the FIG. 13 example, the user selects a color value of 58 in the first fine tuning mode, and then the control system switches to the second fine tuning mode. The second fine tuning range is selected based on the color value from the first fine tuning mode, wherein the user interface is operable to select color values between 57 and 59 (FIG. 13 shows the second fine tuning range centered on the color value from the first fine tuning mode, but this is not required in all embodiments). In the FIG. 13 example, the user selects a color value of 57.8 in the second fine tuning mode, and then the control system switches to an intensity mode, wherein the overall intensity may be adjusted while keeping the color value selected in the second fine tuning mode substantially constant.

Figure 14:
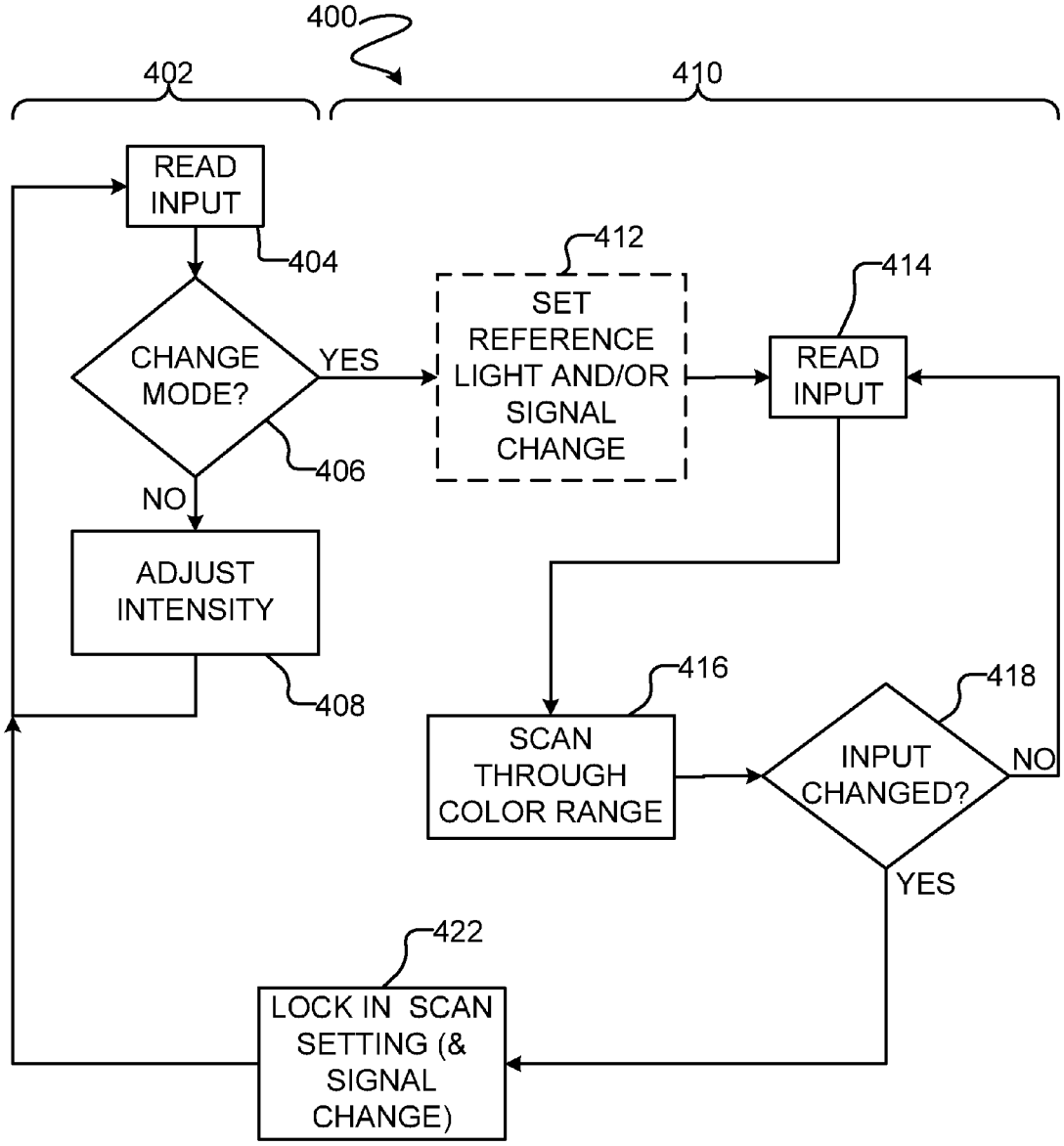
FIG. 14 is a flow chart of a method for controlling a LED-based illumination apparatus according to another embodiment.

FIG. 14 shows a method 400 according to an example embodiment, which a control system for a LED-based illumination apparatus (such as, for example, control system 14) may be configured to execute. Method 400 comprises an intensity mode 402 and a color scanning mode 410. In intensity mode 402, an input is read at step 404 and monitored at step 406 to determine if the input manifests a mode change condition. Detection of mode change conditions in method 400 may be the same as or similar to detection of mode change conditions as described above with respect to method 50.

As long as the input does not manifest a mode change condition (step 406 NO output), method 400 remains in intensity mode 402 and proceeds to step 408. At step 408 the overall intensity of light emitted by the LEDs of the lighting instrument is adjusted according to the input. Adjustment of intensity at step 408 may be the same as or similar to the adjustment at step 58 of method 50 as described above.

If the input does manifest a mode change condition (step 406 YES output), method 400 enters color scanning mode 410. In some embodiments, method 400 includes optional step 412 wherein the control system may set the intensity to a reference level and/or signal a mode change as described above. In color scanning mode 410, the control system reads the input at step 414, and automatically adjusts the LED-based illumination apparatus to scan through a range of available colors at step 416. At step 418, the input is monitored for change. While the input remains unchanged (step 418 NO output), method 400 cycles through steps 414, 416 and 418, and the scanning at step 416 continues until the input is changed. (In the illustrated example, any input change may stop the scanning, but it is to be understood that a more particular action (e.g. a mode change condition) may be required to stop the scanning in some embodiments.) When the input is changed (step 418 YES output), method 400 proceeds to step 422, where the color of light emitted from the LED-based illumination apparatus is set based on the current scan setting, and method 400 returns to intensity mode 402. Method 400 may also optionally comprise signaling a mode change at step 422, as described above.

Figure 15:
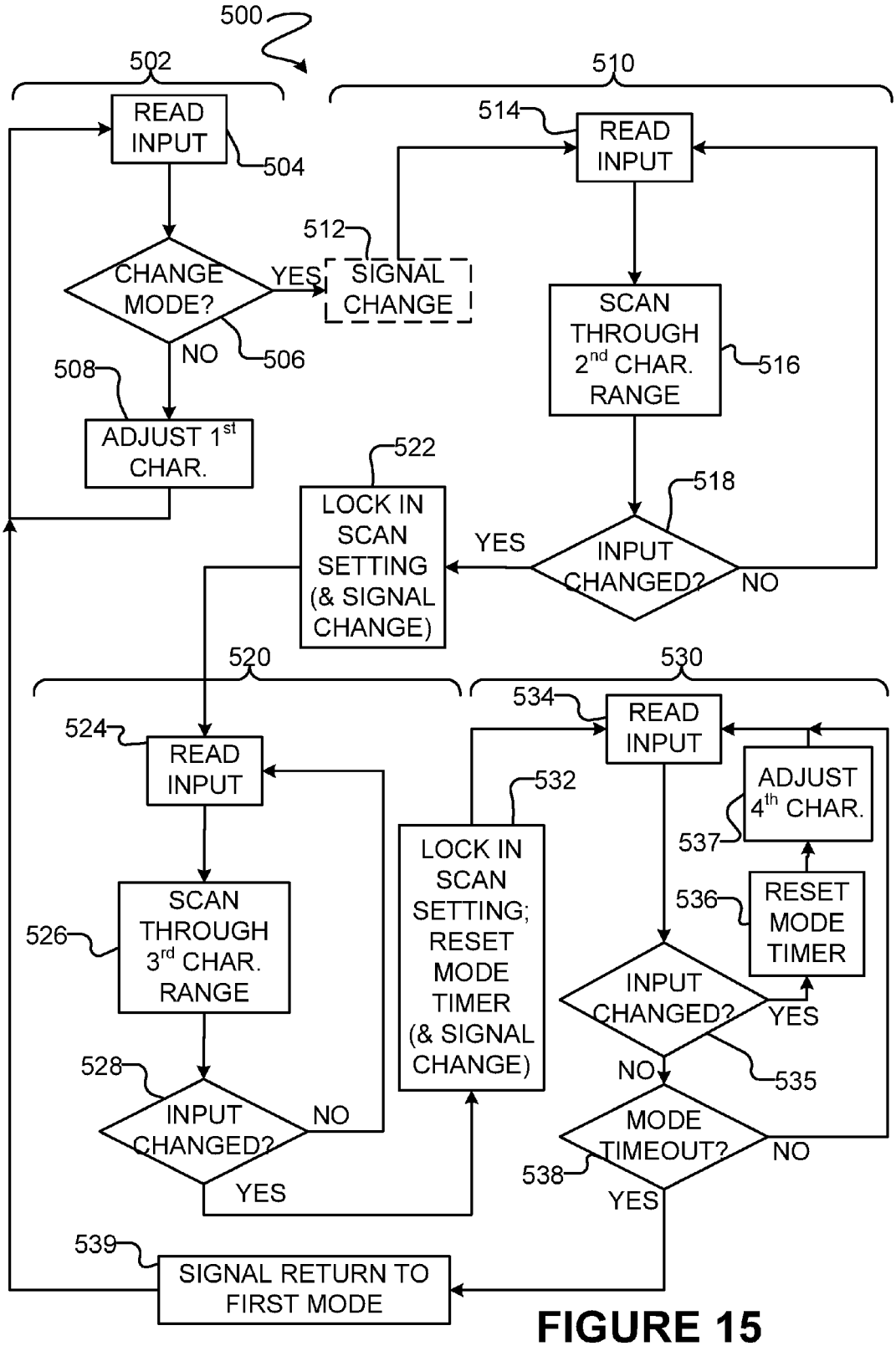
FIG. 15 is a flow chart of a method for controlling a LED-based illumination apparatus according to another embodiment.

Example method 400 employs scanning to cycle through a range of available colors, but it is to be understood that scanning may be applied to adjust other characteristics of light from a LED-based illumination apparatus other than just color, may be used to adjust multiple characteristics of light from a LED-based illumination apparatus, and/or may be used in conjunction with features of other methods such as those described above. For example, FIG. 15 shows a method 500 according to an example embodiment, which a control system for a LED-based illumination apparatus (such as, for example, control system 14) may be configured to execute. Method 500 comprises a first manual mode 502 in which a first characteristic is adjusted, first and second scanning modes 510 and 520, in which second and third characteristics are adjusted, and a second manual mode in which a fourth characteristic is adjusted. In first manual mode 502, an input is read at step 504 and monitored at step 506 to determine if the input manifests a mode change condition. Detection of mode change conditions in method 500 may be the same as or similar to detection of mode change conditions as described above with respect to method 50.

As long as the input does not manifest a mode change condition (step 506 NO output), method 500 remains in first manual mode 502 and proceeds to step 508. At step 508 a first characteristic of light emitted by the LEDs of the lighting instrument is adjusted according to the input.

If the input does manifest a mode change condition (step 506 YES output), method 500 enters first scanning mode 510. In some embodiments, method 500 includes optional step 512 wherein the control system may signal a mode change as described above. In first scanning mode 510, the control system reads the input at step 514, and automatically adjusts the LED-based illumination apparatus to scan through a range of available settings of a second characteristic at step 516. At step 518, the input is monitored for change. While the input remains unchanged (step 518 NO output), method 500 cycles through steps 514, 516 and 518, and the scanning at step 516 continues until the input is changed. (In the illustrated example, any input change may stop the scanning, but it is to be understood that a more particular action (e.g. a mode change condition) may be required to stop the scanning in some embodiments.) When the input is changed (step 518 YES output), method 500 proceeds to step 522, where the second characteristic of light emitted from the LED-based illumination apparatus is set based on the current scan setting, and method 500 proceeds to second scanning mode 520. Method 500 may also optionally comprise signaling a mode change at step 522, as described above.

In second scanning mode 520, the control system reads the input at step 524, and automatically adjusts the LED-based illumination apparatus to scan through a range of available settings of a third characteristic at step 526. At step 528, the input is monitored for change. While the input remains unchanged (step 528 NO output), method 500 cycles through steps 524, 526 and 528, and the scanning at step 526 continues until the input is changed. (In the illustrated example, any input change may stop the scanning, but it is to be understood that a more particular action (e.g. a mode change condition) may be required to stop the scanning in some embodiments.) When the input is changed (step 528 YES output), method 500 proceeds to step 532, where the third characteristic of light emitted from the LED-based illumination apparatus is set based on the current scan setting, and method 500 proceeds to second manual mode 530. Method 500 may also optionally comprise signaling a mode change at step 532, as described above.

In the illustrated embodiment, step 532 also comprises resetting a mode timer. In second manual mode 530, the mode timer tracks the amount of time without a change in the input. In step 534 the input is read and in step 535 the input is monitored for change. Whenever the input is changed (step 535 YES output), the mode timer is reset in step 536, and a fourth characteristic of light from the LEDs is adjusted according to the input in step 537.

While the input remains unchanged, the mode timer runs and is monitored in step 538. If method 500 has been in second manual mode 530 for more than a predetermined timeout period without a change to the input, method 500 proceeds to step 539. At step 539, a signal indicating the return to first manual mode 502 is provided, then method 500 returns to first manual mode 502.

Figure 16:
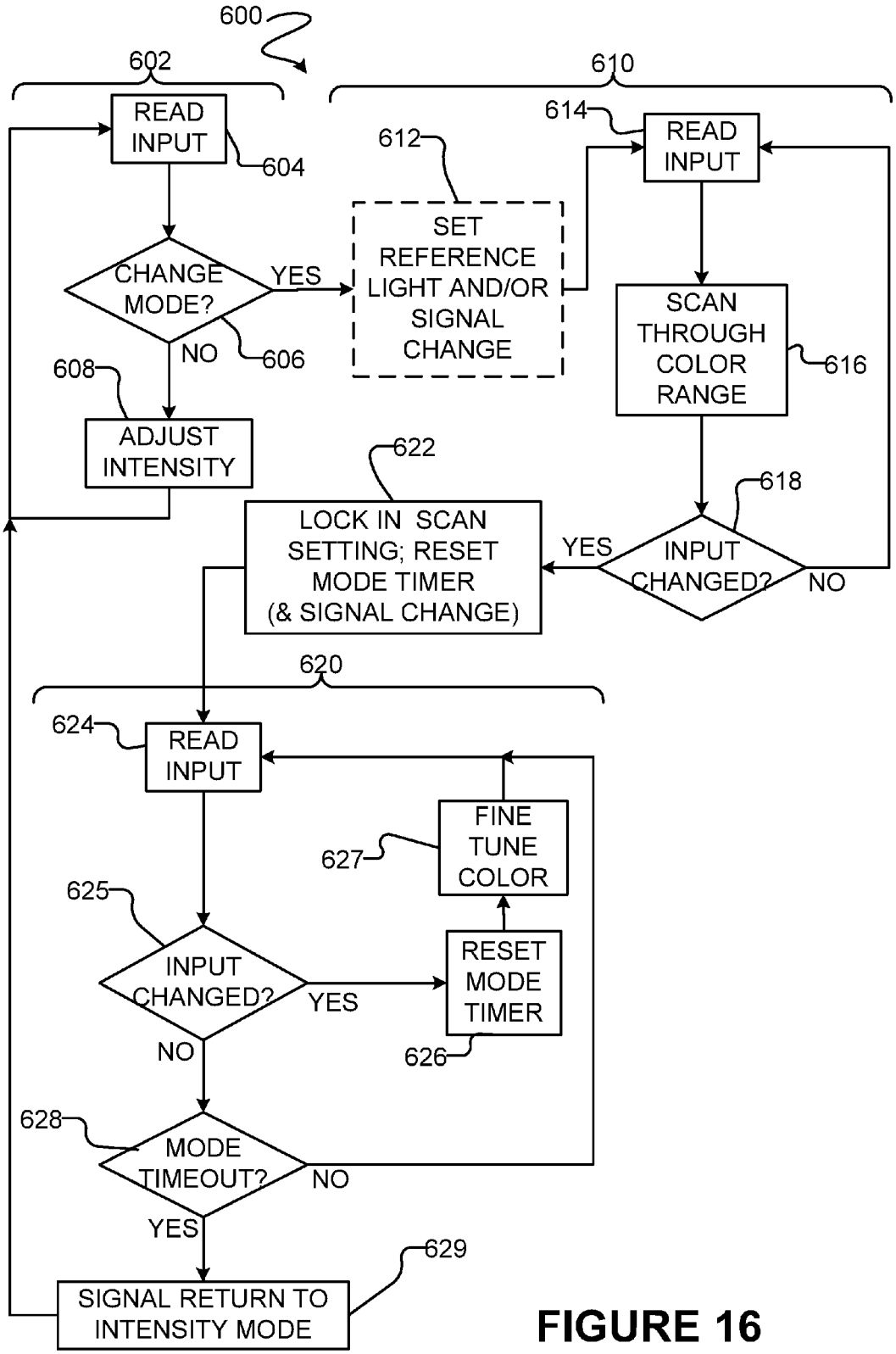
FIG. 16 is a flow chart of a method for controlling a LED-based illumination apparatus according to another embodiment.

FIG. 16 shows a method 600 according to an example embodiment, which a control system for a LED-based illumination apparatus (such as, for example, control system 14) may be configured to execute. Method 600 comprises an intensity mode 602, a color scanning mode 610, and a color fine tuning mode 620. In intensity mode 602, an input is read at step 604 and monitored at step 606 to determine if the input manifests a mode change condition. Detection of mode change conditions in method 600 may be the same as or similar to detection of mode change conditions as described above with respect to method 50.

As long as the input does not manifest a mode change condition (step 606 NO output), method 600 remains in intensity mode 602 and proceeds to step 608. At step 608 the overall intensity of light emitted by the LEDs of the lighting instrument is adjusted according to the input. Adjustment of intensity at step 608 may be the same as or similar to the adjustment at step 58 of method 50 as described above.

If the input does manifest a mode change condition (step 606 YES output), method 600 enters color scanning mode 610. In some embodiments, method 600 includes optional step 612 wherein the control system may set the intensity to a reference level and/or signal a mode change as described above. In color scanning mode 610, the control system reads the input at step 614, and automatically adjusts the LED-based illumination apparatus to scan through a range of available colors at step 616. At step 618, the input is monitored for change. While the input remains unchanged (step 618 NO output), method 400 cycles through steps 614, 616 and 618, and the scanning at step 616 continues until the input is changed. (In the illustrated example, any input change may stop the scanning, but it is to be understood that a more particular action (e.g. a mode change condition) may be required to stop the scanning in some embodiments.) When the input is changed (step 618 YES output), method 600 proceeds to step 622, where the color of light emitted from the LED-based illumination apparatus is set based on the current scan setting, and method 600 proceeds to color fine tuning mode 620. Method 600 may also optionally comprise signaling a mode change at step 622, as described above.

In the illustrated embodiment, step 622 also comprises resetting a mode timer. In color fine tuning mode 620, the mode timer tracks the amount of time without a change in the input. In step 624 the input is read and in step 625 the input is monitored for change. Whenever the input is changed (step 625 YES output), the mode timer is reset in step 626, and the color of light from the LEDs is adjusted within a fine tuning range according to the input in step 627. The fine tuning range may, for example, be a limited range centered on the color set in step 622.

While the input remains unchanged, the mode timer runs and is monitored in step 628. If method 600 has been in color fine tuning mode 620 for more than a predetermined timeout period without a change to the input, method 600 proceeds to step 629. At step 629, a signal indicating the return to intensity mode 602 is provided, then method 600 returns to intensity mode 602.

Those skilled in the art will appreciate that numerous variations and permutations of the above methods are possible. For example, in method 500 the first and second scanning modes may adjust the same characteristic(s), but may scan through the available range of such characteristic(s) in opposite directions. Such an embodiment may be useful for characteristics with a wide range of available settings, so that a user does not need to wait for the whole range of settings to be cycled through if a desired setting is missed. In some embodiments, scanning through a range of settings of a characteristic may comprise adjusting two or more individual parameters of light from the LEDs simultaneously at the same rate, or at different rates. Method 600 could be varied to include individual color adjustment modes and/or additional fine tuning modes similar to those described above with respect to FIGS. 9, 9A and 11-13. Also, the techniques used to trigger mode changes in the various example methods described above may be interchanged, combined and/or varied in different embodiments. Also, in some examples discussed above the control system cycles through modes in response to mode change conditions, but it is to be understood that in some embodiments different mode change conditions may be used to change directly to any one of a plurality of modes.

Certain implementations of the invention comprise computer hardware, software or both hardware and software components which perform a method of the invention. For example, one or more processors in a control system for a device may implement methods as described herein by executing software instructions in a program memory accessible to the processors. Processing hardware in such embodiments may include one or more appropriately-configured programmable processors, programmable logic devices (such as programmable array logic ("PALs") and programmable logic arrays ("PLAs")), digital signal processors ("DSPs"), field programmable gate arrays ("FPGAs"), application specific integrated circuits ("ASICs"), large scale integrated circuits ("LSIs"), very large scale integrated circuits ("VLSIs") or the like. As one skilled in the art will appreciate, these example embodiments are for illustrative purposes only, and methods and systems according to embodiments of the invention may be implemented in any suitable device having appropriately configured processing hardware. In some embodiments, the invention may be implemented in software. For greater clarity, "software" includes (but is not limited to) firmware, resident software, microcode, and the like. Both processing hardware and software may be centralized or distributed (or a combination thereof), in whole or in part, as known to those skilled in the art.

The invention may also be provided in the form of a computer program product accessible from a computer-readable medium for use by or in connection with processing hardware. A computer-readable medium can be any medium which carries a set of computer-readable signals comprising instructions which, when executed by processing hardware, causes the processing hardware to execute a method of the invention. A computer-readable medium may be in any of a wide variety of forms, including an electronic or semiconductor system (e.g. ROM and flash RAM), magnetic or electromagnetic system (e.g. floppy diskettes and hard disk drives), or optical or infrared system (e.g. CD ROMs and DVDs). The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Some embodiments have one or more of the following aspects:

A) An illumination apparatus comprising:

a plurality of LEDs;

a control system connected to receive dimmer-modulated AC line voltage and control the plurality of LEDs, the controller configured to:

operate in a default mode wherein changes in dimmer-modulated AC line voltage adjust a first characteristic of the plurality of LEDs until the dimmer-modulated AC line voltage manifests a mode change condition;

enter a selected mode wherein changes in dimmer-modulated AC line voltage adjust a second characteristic of the plurality of LEDs upon determining that the dimmer-modulated AC line voltage manifests the mode change condition; and, enter a different mode after the dimmer-modulated AC line voltage remains unchanged for a first predetermined time period.

B) An illumination apparatus comprising:

a plurality of LEDs;

a control system connected to receive dimmer-modulated AC line voltage and control the plurality of LEDs, the controller configured to:

operate in a default mode wherein changes in dimmer-modulated AC line voltage adjust a first characteristic of the plurality of LEDs until the dimmer-modulated AC line voltage manifests a mode change condition;

enter a selected mode wherein changes in dimmer-modulated AC line voltage adjust a second characteristic of the plurality of LEDs upon determining that the dimmer-modulated AC line voltage manifests the mode change condition; and, return to the default mode after a predetermined time period.

C) An illumination apparatus comprising:

a plurality of LEDs;

a control system connected to receive dimmer-modulated AC line voltage and control the plurality of LEDs, the controller configured to:

operate in a first mode wherein changes in dimmer-modulated AC line voltage adjust a first characteristic of the plurality of LEDs until the dimmer-modulated AC line voltage manifests a mode change condition;

enter a second mode wherein changes in dimmer-modulated AC line voltage adjust a second characteristic of the plurality of LEDs upon determining that the dimmer-modulated AC line voltage manifests the mode change condition; and, return to the first mode upon determining that the dimmer-modulated AC line voltage manifests the mode change condition again.

D) An illumination apparatus comprising:

a plurality of LEDs;

a control system connected to receive dimmer-modulated AC line voltage and control the plurality of LEDs, the control system having a plurality of modes arranged in a cycle order, each mode for controlling a corresponding characteristic of the plurality of LEDs, the control system configured to:

operate in a current mode wherein changes in dimmer-modulated AC line voltage adjust a corresponding characteristic of the plurality of LEDs until the dimmer-modulated AC line voltage manifests a mode change condition;

enter a next mode in the cycle upon determining that the dimmer-modulated AC line voltage manifests a next mode change condition; and, enter a previous mode in the cycle upon determining that the dimmer-modulated AC line voltage manifests a previous mode change condition.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An illumination apparatus comprising:

a plurality of LEDs;

a control system connected to receive dimmer-modulated AC line voltage and control the plurality of LEDs, the control system configured to:

operate in a default mode wherein changes in dimmer-modulated AC line voltage adjust a first characteristic of the plurality of LEDs until the dimmer-modulated AC line voltage manifests a first mode change condition;

enter a scanning mode upon determining that the dimmer-modulated AC line voltage manifests the first mode change condition wherein the control system automatically adjusts a second characteristic of the plurality of LEDs to scan through a range of adjustment settings; and, set the second characteristic of the plurality of LEDs based on a current setting in the range of adjustment settings and enter a different mode upon determining that the dimmer-modulated AC line voltage manifests a second mode change condition.

2. The illumination apparatus of claim 1 wherein the default mode comprises an intensity mode wherein the control system is configured to transform changes in the dimmer-modulated AC line voltage into changes in an overall intensity of light emitted by the LEDs.

3. The illumination apparatus of claim 2 wherein the LEDs comprise at least one LED of a first color and at least one LED of a second color different from the first color, and wherein the scanning mode comprises a color scanning mode wherein the control system is configured to scan though an available range of composite colors of light emitted by the LEDs.

4. The illumination apparatus of claim 3 wherein the different mode comprises a first fine tuning mode wherein the control system is configured to adjust the composite color of light emitted by the LEDs within a first fine tuning range which is narrower than the available range in the color scanning mode.

5. The illumination apparatus of claim 4 wherein the control system is configured to enter a second fine tuning mode after the dimmer-modulated AC line voltage remains unchanged for a second predetermined time period in the first fine tuning mode, wherein, in the second fine tuning mode the control system is configured to adjust the composite color of light emitted by the LEDs within a second fine tuning range which is narrower than the first fine tuning range.

6. The illumination apparatus of claim 4 wherein, after the dimmer-modulated AC line voltage remains unchanged for a second predetermined time period:

the control system is configured to enter a second fine tuning mode if the composite color has been adjusted in the first fine tuning mode; and, the control system is configured to return to the intensity mode if the composite color has not been adjusted in the first fine tuning mode.

7. The illumination apparatus according to claim 6 wherein the control system is configured to change from the second fine tuning mode to the intensity mode after the dimmer-modulated AC line voltage remains unchanged for a third predetermined time period.

8. The illumination apparatus of claim 4 wherein the control system is configured to enter a second fine tuning mode after the occurrence of a third mode change condition, wherein, in the second fine tuning mode the control system is configured to adjust the composite color of light emitted by the LEDs within a second fine tuning range which is narrower than the first fine tuning range.

9. The illumination apparatus of claim 8 wherein, after the occurrence of the third mode change condition:

the control system is configured to enter the second fine tuning mode if the composite color has been adjusted in the first fine tuning mode; and, the control system is configured to return to the intensity mode if the composite color has not been adjusted in the first fine tuning mode.

10. The illumination apparatus according to claim 9 wherein the control system is configured to change from the second fine tuning mode to the intensity mode after the occurrence of a fourth mode change condition.

11. The illumination apparatus of claim 3 wherein the different mode comprises a first color adjustment mode wherein the control system is configured to adjust the intensity of the first color of light emitted by the LEDs.

12. The illumination apparatus of claim 11 wherein the control system is configured to enter a second color adjustment mode after the dimmer-modulated AC line voltage remains unchanged for a second predetermined time period in the first color adjustment mode, wherein, in the second color adjustment mode the control system is configured to adjust the intensity of the second color of light emitted by the LEDs.

13. The illumination apparatus of claim 12 wherein the LEDs comprise at least one LED of a third color different from the first and second colors, and wherein the control system is configured to enter a third color adjustment mode after the dimmer-modulated AC line voltage remains unchanged for a third predetermined time period in the second color adjustment mode, wherein, in the third color adjustment mode the control system is configured to adjust the intensity of the third color of light emitted by the LEDs.

14. The illumination apparatus of claim 3 wherein, in the color scanning mode the controller is configured to maintain the overall intensity of light substantially constant at a first level which is at or below a maximum overall intensity.

15. The illumination apparatus of claim 1 wherein the different mode comprises the default mode.

16. The illumination apparatus of claim 1 wherein the controller is configured to cause a change in the light emitted by at least one of the LEDs to signal mode changes.

17. The illumination apparatus of claim 1 wherein the first mode change condition comprises the AC line voltage being turned off and on a predetermined number of times within a predetermined time period.

18. The illumination apparatus of claim 1 wherein the first mode change condition comprises a parameter of the AC line voltage transitioning between below a threshold and above the threshold a predetermined number of times in a predetermined time period.

19. The illumination apparatus of claim 18 wherein the threshold for downward transitions is different from the threshold for upward transitions.

20. The illumination apparatus of claim 18 wherein the threshold is based on a current value of the parameter of the AC line voltage.

21. The illumination apparatus of claim 1 wherein the second mode change condition comprises any change in the AC line voltage.

22. The illumination apparatus of claim 1 wherein the first mode change condition comprises the AC line voltage being turned off and on a predetermined number of times in a row, wherein an on time during which the AC voltage is on is less than a predetermined time period for each of the predetermined number of times.

23. A method for controlling an LED-based illumination apparatus comprising a plurality of LEDs, the method comprising:

receiving dimmer-modulated AC line voltage;

controlling the LEDs in a default mode whereby changes in the dimmer-modulated AC line voltage are transformed into changes in a first characteristic of the plurality of LEDs until the dimmer-modulated AC line voltage manifests a first mode change condition;

controlling the LEDs in a scanning mode upon determining that the dimmer-modulated AC line voltage manifests the first mode change condition wherein in the scanning mode a second characteristic of the plurality of LEDs is automatically adjusted to scan through an available range of adjustment settings; and, setting the second characteristic based on a current setting in the range of adjustment setting and controlling the LEDs in a different mode when the dimmer-modulated AC line voltage manifests a second mode change condition.

24. The method of claim 23 wherein the default mode comprises an intensity mode and the first characteristic comprises an overall intensity of light emitted by the LEDs.

25. The method of claim 24 wherein the LEDs comprise at least one LED of a first color and at least one LED of a second color different from the first color, and wherein the scanning mode comprises a color scanning mode and the second characteristic comprises a composite color of light emitted by the LEDs.

26. The method of claim 25 wherein the different mode comprises a first fine tuning mode wherein the composite color of light emitted by the LEDs is adjustable within a first fine tuning range which is narrower than the available range of adjustment setting in the color scanning mode.

27. The method of claim 26 comprising entering a second fine tuning mode after the dimmer-modulated AC line voltage remains unchanged for a second predetermined time period in the first fine tuning mode, wherein, in the second fine tuning mode the control system is configured to adjust the composite color of light emitted by the LEDs within a second fine tuning range which is narrower than the first fine tuning range.

28. The method of claim 26 comprising, after the dimmer-modulated AC line voltage remains unchanged for the second predetermined time period:

entering the second fine tuning mode if the composite color has been adjusted in the first fine tuning mode; and, returning to the intensity mode if the composite color has not been adjusted in the first fine tuning mode.

29. The method of claim 28 comprising changing from the second fine tuning mode to the intensity mode after the dimmer-modulated AC line voltage remains unchanged for a third predetermined time period.

30. The method of claim 25 wherein, in the color scanning mode the overall intensity of light emitted by the LEDs is maintained substantially constant at a first level which is at or below a maximum overall intensity.

31. The method of claim 23 wherein the different mode comprises the default mode.

32. The method of claim 23 wherein the first mode change condition comprises the AC line voltage being turned off and on a predetermined number of times within a predetermined time period.

33. The method of claim 23 comprising changing the light emitted by at least one of the LEDs to signal mode changes.

34. The method of claim 23 wherein the second mode change condition comprises any change in the AC line voltage.

35. A controller for controlling a plurality of LEDs, the controller comprising:

a dimming input for receiving a dimmer control signal representative of dimmer-modulated AC line conditions;

a plurality of outputs for controlling the plurality of LEDs;

a processor connected to receive the dimmer control signal and provide LED control signals to the plurality of outputs, and a memory storing instructions which, when executed by the processor, cause the controller to execute a method according to claim 23.

36. The method of claim 23 wherein the first mode change condition comprises the AC line voltage being turned off and on a predetermined number of times in a row, wherein an on time during which the AC voltage is on is less than a predetermined time period for each of the predetermined number of times.

* * * * *